US009384739B2

(12) United States Patent
Lecomte et al.

(10) Patent No.: US 9,384,739 B2
(45) Date of Patent: Jul. 5, 2016

(54) APPARATUS AND METHOD FOR ERROR CONCEALMENT IN LOW-DELAY UNIFIED SPEECH AND AUDIO CODING

(71) Applicants: Fraunhofer-Gesellschaft zur Foerderung der angewandten Forschung e.V., Munich (DE); Technische Universitaet Ilmenau, Ilmenau (DE)

(72) Inventors: Jeremie Lecomte, Fuerth (DE); Martin Dietz, Nuremberg (DE); Michael Schnabel, Geroldsgruen (DE); Ralph Sperschneider, Ebermannstadt (DE)

(73) Assignees: Fraunhofer-Gesellschaft zur Foerderung der angewandten Forschung e.V., Munich (DE); Technische Universitaet Ilmenau, Ilmenau (DE)

( * ) Notice: Subject to any disclaimer, the term of this patent is extended or adjusted under 35 U.S.C. 154(b) by 316 days.

(21) Appl. No.: 13/966,536

(22) Filed: Aug. 14, 2013

(65) Prior Publication Data

US 2013/0332152 A1 Dec. 12, 2013

Related U.S. Application Data

(63) Continuation of application No. PCT/EP2012/052395, filed on Feb. 13, 2012.

(60) Provisional application No. 61/442,632, filed on Feb. 14, 2011.

(51) Int. Cl.
*G10L 19/00* (2013.01)
*G10L 19/012* (2013.01)
(Continued)

(52) U.S. Cl.
CPC ..... *G10L 19/00* (2013.01); *G10K 11/16* (2013.01); *G10L 19/005* (2013.01);
(Continued)

(58) Field of Classification Search
CPC ..... G10L 19/00; G10L 19/005; G10L 19/023; G10L 19/03; G10L 19/18; G10L 19/22; G10L 2019/00
USPC ..... 704/200, 205, 206, 207, 208, 219, 225, 704/211, 500–504
See application file for complete search history.

(56) References Cited

U.S. PATENT DOCUMENTS 5,537,510 A 7/1996 Kim
5,598,506 A * 1/1997 Wigren ..... G10L 19/005 704/228
(Continued)

FOREIGN PATENT DOCUMENTS

AU 2007/312667 4/2008
CA 2730239 A1 1/2010
(Continued)

OTHER PUBLICATIONS

A Silence Compression Scheme for G.729 Optimized for Terminals Conforming to Recommendation V.70, ITU-T Recommendation G.729—Annex B, International Telecommunication Union, Nov. 1996, pp. 1-16.
(Continued)

*Primary Examiner* — Paras D Shah
(74) *Attorney, Agent, or Firm* — Michael A. Glenn; Perkins Coie LLP

(57) ABSTRACT

An apparatus for generating spectral replacement values for an audio signal has a buffer unit for storing previous spectral values relating to a previously received error-free audio frame. Moreover, the apparatus includes a concealment frame generator for generating the spectral replacement values, when a current audio frame has not been received or is erroneous. The previously received error-free audio frame has filter information, the filter information having associated a filter stability value indicating a stability of a prediction filter. The concealment frame generator is adapted to generate the spectral replacement values based on the previous spectral values and based on the filter stability value.

16 Claims, 8 Drawing Sheets

(51) Int. Cl.

| | |
|---|---|
| ***G10K 11/16*** | (2006.01) |
| ***G10L 19/005*** | (2013.01) |
| ***G10L 19/12*** | (2013.01) |
| ***G10L 19/03*** | (2013.01) |
| ***G10L 19/22*** | (2013.01) |
| ***G10L 21/0216*** | (2013.01) |
| ***G10L 25/78*** | (2013.01) |
| *G10L 19/04* | (2013.01) |
| *G10L 19/02* | (2013.01) |
| *G10L 25/06* | (2013.01) |
| *G10L 19/025* | (2013.01) |
| *G10L 19/107* | (2013.01) |

(52) U.S. Cl.

CPC ..... *G10L 19/012* (2013.01); *G10L 19/03* (2013.01); *G10L 19/12* (2013.01); *G10L 19/22* (2013.01); *G10L 21/0216* (2013.01); *G10L 25/78* (2013.01); *G10L 19/025* (2013.01); *G10L 19/0212* (2013.01); *G10L 19/04* (2013.01); *G10L 19/107* (2013.01); *G10L 25/06* (2013.01)

(56) References Cited

U.S. PATENT DOCUMENTS

| | | | | |
|---|---|---|---|---|
| 5,606,642 | A | 2/1997 | Stautner et al. | |
| 5,684,920 | A | 11/1997 | Iwakami et al. | |
| 5,848,391 | A | 12/1998 | Bosi et al. | |
| 5,953,698 | A | 9/1999 | Hayata | |
| 5,960,389 | A | 9/1999 | Jarvinen et al. | |
| 6,070,137 | A | 5/2000 | Bloebaum et al. | |
| 6,134,518 | A | 10/2000 | Cohen et al. | |
| 6,173,257 | B1 | 1/2001 | Gao | |
| 6,236,960 | B1 | 5/2001 | Peng et al. | |
| 6,317,117 | B1 | 11/2001 | Goff | |
| 6,532,443 | B1 | 3/2003 | Nishiguchi et al. | |
| 6,587,817 | B1 | 7/2003 | Vähätalo et al. | |
| 6,636,829 | B1 * | 10/2003 | Benyassine et al. | 704/201 |
| 6,757,654 | B1 | 6/2004 | Westerlund et al. | |
| 6,879,955 | B2 | 4/2005 | Rao et al. | |
| 6,969,309 | B2 * | 11/2005 | Carpenter | 451/285 |
| 7,003,448 | B1 * | 2/2006 | Lauber et al. | 704/200.1 |
| 7,124,079 | B1 | 10/2006 | Johansson et al. | |
| 7,249,014 | B2 | 7/2007 | Kannan et al. | |
| 7,280,959 | B2 | 10/2007 | Bessette | |
| 7,343,283 | B2 | 3/2008 | Ashley et al. | |
| 7,363,218 | B2 | 4/2008 | Jabri et al. | |
| 7,519,535 | B2 | 4/2009 | Spindola | |
| 7,519,538 | B2 | 4/2009 | Villemoes et al. | |
| 7,536,299 | B2 | 5/2009 | Cheng et al. | |
| 7,565,286 | B2 * | 7/2009 | Gracie et al. | 704/217 |
| 7,587,312 | B2 | 9/2009 | Kim | |
| 7,707,034 | B2 | 4/2010 | Sun et al. | |
| 7,711,563 | B2 * | 5/2010 | Chen | 704/262 |
| 7,788,105 | B2 | 8/2010 | Miseki | |
| 7,809,556 | B2 * | 10/2010 | Goto et al. | 704/219 |
| 7,873,511 | B2 | 1/2011 | Herre et al. | |
| 7,877,253 | B2 * | 1/2011 | Krishnan et al. | 704/225 |
| 7,933,769 | B2 | 4/2011 | Bessette | |
| 7,979,271 | B2 | 7/2011 | Bessette | |
| 7,987,089 | B2 | 7/2011 | Krishnan et al. | |
| 8,045,572 | B1 * | 10/2011 | Li et al. | 370/419 |
| 8,078,458 | B2 * | 12/2011 | Zopf et al. | 704/219 |
| 8,121,831 | B2 | 2/2012 | Oh et al. | |
| 8,160,274 | B2 | 4/2012 | Bongiovi | |
| 8,239,192 | B2 * | 8/2012 | Kovesi et al. | 704/219 |
| 8,255,207 | B2 | 8/2012 | Vaillancourt et al. | |
| 8,255,213 | B2 * | 8/2012 | Yoshida et al. | 704/230 |
| 8,364,472 | B2 * | 1/2013 | Ehara | 704/207 |
| 8,428,936 | B2 | 4/2013 | Mittal et al. | |
| 8,566,106 | B2 | 10/2013 | Salami et al. | |
| 8,630,862 | B2 | 1/2014 | Geiger et al. | |
| 8,630,863 | B2 | 1/2014 | Son et al. | |
| 8,825,496 | B2 | 9/2014 | Setiawan et al. | |
| 8,954,321 | B1 | 2/2015 | Beack et al. | |
| 2002/0111799 | A1 | 8/2002 | Bernard | |
| 2002/0184009 | A1 | 12/2002 | Heikkinen | |
| 2003/0009325 | A1 | 1/2003 | Kirchherr et al. | |
| 2003/0033136 | A1 | 2/2003 | Lee | |
| 2003/0046067 | A1 | 3/2003 | Gradl | |
| 2003/0078771 | A1 | 4/2003 | Jung et al. | |
| 2003/0225576 | A1 | 12/2003 | Li et al. | |
| 2004/0046236 | A1 * | 3/2004 | Collier | 257/666 |
| 2004/0093368 | A1 | 5/2004 | Lee et al. | |
| 2004/0225505 | A1 | 11/2004 | Andersen et al. | |
| 2005/0021338 | A1 | 1/2005 | Graboi et al. | |
| 2005/0065785 | A1 | 3/2005 | Bessette | |
| 2005/0091044 | A1 | 4/2005 | Ramo et al. | |
| 2005/0096901 | A1 | 5/2005 | Uvliden et al. | |
| 2005/0130321 | A1 | 6/2005 | Nicholson et al. | |
| 2005/0131696 | A1 | 6/2005 | Wang et al. | |
| 2005/0154584 | A1 | 7/2005 | Jelinek et al. | |
| 2005/0165603 | A1 | 7/2005 | Bessette et al. | |
| 2005/0192798 | A1 | 9/2005 | Vainio et al. | |
| 2005/0240399 | A1 | 10/2005 | Makinen | |
| 2005/0278171 | A1 | 12/2005 | Suppappola et al. | |
| 2006/0116872 | A1 | 6/2006 | Byun et al. | |
| 2006/0206334 | A1 | 9/2006 | Kapoor et al. | |
| 2006/0271356 | A1 | 11/2006 | Vos | |
| 2006/0293885 | A1 | 12/2006 | Gournay et al. | |
| 2007/0016404 | A1 | 1/2007 | Kim et al. | |
| 2007/0050189 | A1 | 3/2007 | Cruz-Zeno et al. | |
| 2007/0100607 | A1 | 5/2007 | Villemoes | |
| 2007/0147518 | A1 | 6/2007 | Bessette | |
| 2007/0160218 | A1 | 7/2007 | Jakka et al. | |
| 2007/0171931 | A1 | 7/2007 | Manjunath et al. | |
| 2007/0172047 | A1 * | 7/2007 | Coughlan et al. | 379/202.01 |
| 2007/0225971 | A1 | 9/2007 | Bessette | |
| 2007/0253577 | A1 | 11/2007 | Yen et al. | |
| 2007/0282603 | A1 | 12/2007 | Bessette | |
| 2008/0010064 | A1 | 1/2008 | Takeuchi et al. | |
| 2008/0015852 | A1 | 1/2008 | Kruger et al. | |
| 2008/0027719 | A1 | 1/2008 | Kirshnan et al. | |
| 2008/0052068 | A1 | 2/2008 | Aguilar et al. | |
| 2008/0208599 | A1 | 8/2008 | Rosec et al. | |
| 2008/0275580 | A1 | 11/2008 | Andersen | |
| 2009/0024397 | A1 | 1/2009 | Ryu et al. | |
| 2009/0076807 | A1 * | 3/2009 | Xu et al. | 704/207 |
| 2009/0110208 | A1 | 4/2009 | Choo et al. | |
| 2009/0204412 | A1 * | 8/2009 | Kovesi | G10L 19/083 704/500 |
| 2009/0226016 | A1 | 9/2009 | Fitz et al. | |
| 2009/0319283 | A1 | 12/2009 | Schnell et al. | |
| 2009/0326930 | A1 * | 12/2009 | Kawashima et al. | 704/207 |
| 2010/0017200 | A1 | 1/2010 | Oshikiri et al. | |
| 2010/0063812 | A1 | 3/2010 | Gao | |
| 2010/0070270 | A1 | 3/2010 | Gao | |
| 2010/0106496 | A1 | 4/2010 | Morii et al. | |
| 2010/0138218 | A1 | 6/2010 | Geiger | |
| 2010/0198586 | A1 | 8/2010 | Edler et al. | |
| 2010/0217607 | A1 | 8/2010 | Neuendorf et al. | |
| 2010/0268542 | A1 | 10/2010 | Kim et al. | |
| 2011/0007827 | A1 * | 1/2011 | Virette | G10L 19/005 375/259 |
| 2011/0153333 | A1 | 6/2011 | Bessette | |
| 2011/0161088 | A1 | 6/2011 | Bayer et al. | |
| 2011/0178795 | A1 | 7/2011 | Bayer et al. | |
| 2011/0218797 | A1 | 9/2011 | Mittal et al. | |
| 2011/0218799 | A1 | 9/2011 | Mittal et al. | |
| 2011/0218801 | A1 * | 9/2011 | Vary et al. | 704/208 |
| 2011/0257979 | A1 | 10/2011 | Gao | |
| 2011/0270616 | A1 | 11/2011 | Garudadri et al. | |
| 2011/0311058 | A1 | 12/2011 | Oh et al. | |
| 2012/0022881 | A1 | 1/2012 | Geiger et al. | |
| 2012/0226505 | A1 | 9/2012 | Lin et al. | |
| 2012/0271644 | A1 | 10/2012 | Bessette et al. | |
| 2013/0332151 | A1 | 12/2013 | Fuchs et al. | |

FOREIGN PATENT DOCUMENTS

| | | | |
|---|---|---|---|
| CN | 1274456 | A | 11/2000 |
| CN | 1344067 | A | 4/2002 |
| CN | 1381956 | A | 11/2002 |

(56) References Cited

FOREIGN PATENT DOCUMENTS

| | | | |
|---|---|---|---|
| CN | 1437747 | A | 8/2003 |
| CN | 1539137 | A | 10/2004 |
| CN | 1539138 | A | 10/2004 |
| CN | 101351840 | | 10/2006 |
| CN | 101110214 | A | 1/2008 |
| CN | 101366077 | A | 2/2009 |
| CN | 101371295 | A | 2/2009 |
| CN | 101379551 | A | 3/2009 |
| CN | 101388210 | A | 3/2009 |
| CN | 101425292 | A | 5/2009 |
| CN | 101483043 | A | 7/2009 |
| CN | 101488344 | A | 7/2009 |
| CN | 101743587 | | 6/2010 |
| CN | 101770775 | A | 7/2010 |
| DE | 102008015702 | A1 | 8/2009 |
| EP | 0665530 | A1 | 8/1995 |
| EP | 0673566 | A1 | 9/1995 |
| EP | 0758123 | A2 | 2/1997 |
| EP | 0784846 | A1 | 7/1997 |
| EP | 0843301 | B1 | 5/1998 |
| EP | 1120775 | A1 | 8/2001 |
| EP | 1852851 | | 7/2007 |
| EP | 2107556 | | 7/2009 |
| EP | 2109098 | A2 | 10/2009 |
| EP | 2144230 | A1 | 1/2010 |
| FR | 2911228 | A1 | 7/2008 |
| JP | H08263098 | A | 10/1996 |
| JP | 10039898 | A | 2/1998 |
| JP | H10214100 | A | 8/1998 |
| JP | H11502318 | A | 2/1999 |
| JP | H1198090 | A | 4/1999 |
| JP | 2000357000 | A | 12/2000 |
| JP | 2002-118517 | | 4/2002 |
| JP | 2003501925 | A | 1/2003 |
| JP | 2003506764 | A | 2/2003 |
| JP | 2004513381 | A | 4/2004 |
| JP | 2004514182 | A | 5/2004 |
| JP | 2005534950 | A | 11/2005 |
| JP | 2006504123 | A | 2/2006 |
| JP | 2007065636 | A | 3/2007 |
| JP | 2007523388 | A | 8/2007 |
| JP | 2007525707 | A | 9/2007 |
| JP | 2007538282 | A | 12/2007 |
| JP | 2008-15281 | | 1/2008 |
| JP | 2008513822 | A | 5/2008 |
| JP | 2008261904 | A | 10/2008 |
| JP | 2009508146 | A | 2/2009 |
| JP | 2009075536 | A | 4/2009 |
| JP | 2009522588 | A | 6/2009 |
| JP | 2009-527773 | | 7/2009 |
| JP | 2010530084 | A | 9/2010 |
| JP | 2010-538314 | | 12/2010 |
| JP | 2010539528 | A | 12/2010 |
| JP | 2011501511 | A | 1/2011 |
| JP | 2011527444 | A | 10/2011 |
| KR | 1020040043278 | A | 5/2004 |
| KR | 1020060025203 | A | 3/2006 |
| KR | 1020070088276 | A | 8/2007 |
| KR | 1020100059726 | A | 6/2010 |
| KR | 1020100134709 | | 4/2015 |
| RU | 2169992 | C2 | 6/2001 |
| RU | 2183034 | C2 | 5/2002 |
| RU | 2003118444 | A | 12/2004 |
| RU | 2004138289 | A | 6/2005 |
| RU | 2296377 | C2 | 3/2007 |
| RU | 2302665 | C2 | 7/2007 |
| RU | 2312405 | C2 | 12/2007 |
| RU | 2331933 | C2 | 8/2008 |
| RU | 2335809 | C2 | 10/2008 |
| RU | 2008126699 | A | 2/2010 |
| RU | 2009107161 | A | 9/2010 |
| RU | 2009118384 | A | 11/2010 |
| TW | 200830277 | | 10/1996 |
| TW | 200943279 | | 10/1998 |
| TW | 201032218 | | 9/1999 |
| TW | 380246 | B | 1/2000 |
| TW | 469423 | B | 12/2001 |
| TW | I253057 | B | 4/2006 |
| TW | 200703234 | A | 1/2007 |
| TW | 200729156 | A | 8/2007 |
| TW | 200841743 | A | 10/2008 |
| TW | I313856 | B | 8/2009 |
| TW | 200943792 | A | 10/2009 |
| TW | I316225 | B | 10/2009 |
| TW | I 320172 | | 2/2010 |
| TW | 201009810 | A | 3/2010 |
| TW | 201009812 | A | 3/2010 |
| TW | I324762 | B | 5/2010 |
| TW | 201027517 | A | 7/2010 |
| TW | 201030735 | A | 8/2010 |
| TW | 201040943 | | 11/2010 |
| TW | I333643 | B | 11/2010 |
| TW | 201103009 | | 1/2011 |
| WO | 92/22891 | A1 | 12/1992 |
| WO | 95/10890 | A1 | 4/1995 |
| WO | 95/30222 | A1 | 11/1995 |
| WO | 96/29696 | A1 | 9/1996 |
| WO | 00/31719 | A2 | 6/2000 |
| WO | 0075919 | A1 | 12/2000 |
| WO | 02/101724 | A1 | 12/2002 |
| WO | WO-02101722 | | 12/2002 |
| WO | 2004027368 | A1 | 4/2004 |
| WO | 2005041169 | A2 | 5/2005 |
| WO | 2005078706 | A1 | 8/2005 |
| WO | 2005081231 | A1 | 9/2005 |
| WO | 2005112003 | A1 | 11/2005 |
| WO | 2006126844 | A2 | 11/2006 |
| WO | WO-2007051548 | | 5/2007 |
| WO | 2007083931 | A1 | 7/2007 |
| WO | WO-2007073604 | | 7/2007 |
| WO | WO 2007073604 | A1 * | 7/2007 |
| WO | WO2007/096552 | | 8/2007 |
| WO | WO-2008013788 | | 10/2008 |
| WO | 2008/157296 | A1 | 12/2008 |
| WO | WO-2009029032 | | 3/2009 |
| WO | 2009077321 | A3 | 10/2009 |
| WO | 2009121499 | A1 | 10/2009 |
| WO | 2010/003563 | A1 | 1/2010 |
| WO | 2010003491 | A1 | 1/2010 |
| WO | WO-2010/003491 | | 1/2010 |
| WO | WO-2010040522 | | 4/2010 |
| WO | 2010059374 | A1 | 5/2010 |
| WO | 2010/081892 | A2 | 7/2010 |
| WO | 2010093224 | A2 | 8/2010 |
| WO | 2011/006369 | A1 | 1/2011 |
| WO | WO-2010003532 | | 2/2011 |
| WO | 2011/048117 | A1 | 4/2011 |
| WO | WO-2011048094 | | 4/2011 |
| WO | 2011/147950 | A1 | 12/2011 |

OTHER PUBLICATIONS

Martin, R., Spectral Subtraction Based on Minimum Statistics, Proceedings of European Signal Processing Conference (EUSIPCO), Edinburg, Scotland, Great Britain, Sep. 1994, pp. 1182-1185.

"Digital Cellular Telecommunications System (Phase 2+); Universal Mobile Telecommunications System (UMTS); LTE; Speech codec speech processing functions; Adaptive Multi-Rate-Wideband (AMR-)WB Speech Codec; Transcoding Functions (3GPP TS 26.190 version 9.0.0", Technical Specification, European Telecommunications Standards Institute (ETSI) 650, Route Des Lucioles; F-06921 Sophia-Antipolis; France; No. V.9.0.0, Jan. 1, 2012, 54 Pages.

"IEEE Signal Processing Letters", IEEE Signgal Processing Society. vol. 15. ISSN 1070-9908., 2008, 9 Pages.

"Information Technology—MPEG Audio Technologies—Part 3: Unified Speech and Audio Coding", ISO/IEC JTC 1/SC 29 ISO/IEC DIS 23003-3, Feb. 9, 2011, 233 Pages.

"WD7 of USAC", International Organisation for Standardisation Organisation Internationale De Normailisation. ISO/IEC JTC1/SC29/WG11. Coding of Moving Pictures and Audio. Dresden, Germany., Apr. 2010, 148 Pages.

(56) References Cited

OTHER PUBLICATIONS

3GPP, , "3rd Generation Partnership Project; Technical Specification Group Service and System Aspects. Audio Codec Processing Functions. Exteneded AMR Wideband Codec; Transcoding functions (Release 6).", 3GPP Draft; 26.290, V2.0.0 3rd Generation Partnership Project (3GPP), Mobile Competence Centre; Valbonne, France., Sep. 2004, pp. 1-85.
Ashley, J et al., "Wideband Coding of Speech Using a Scalable Pulse Codebook", 2000 IEEE Speech Coding Proceedings., Sep. 17, 2000, pp. 148-150.
Bessette, B et al., "The Adaptive Multirate Wideband Speech Codec (AMR-WB)", IEEE Transactions on Speech and Audio Processing, IEEE Service Center. New York. vol. 10, No. 8., Nov. 1, 2002, pp. 620-636.
Bessette, B et al., "Universal Speech/Audio Coding Using Hybrid ACELP/TCX Techniques", ICASSP 2005 Proceedings. IEEE International Conference on Acoustics, Speech, and Signal Processing, vol. 3,, Jan. 2005, pp. 301-304.
Bessette, B et al., "Wideband Speech and Audio Codec at 16/24/32 Kbit/S Using Hybrid ACELP/TCX Techniques", 1999 IEEE Speech Coding Proceedings. Porvoo, Finland., Jun. 20, 1999, pp. 7-9.
Ferreira, A et al., "Combined Spectral Envelope Normalization and Subtraction of Sinusoidal Components in the ODFTand MDCT Frequency Domains", 2001 IEEE Workshop on Applications of Signal Processing to Audio and Acoustics., Oct. 2001, pp. 51-54.
Fischer, et al., "Enumeration Encoding and Decoding Algorithms for Pyramid Cubic Lattice and Trellis Codes", IEEE Transactions on Information Theory. IEEE Press, USA, vol. 41, No. 6, Part 2., Nov. 1, 1995, pp. 2056-2061.
Hermansky, H et al., "Perceptual linear predictive (PLP) analysis of speech", J. Acoust. Soc. Amer. 87 (4)., Apr. 1990, pp. 1738-1751.
Hofbauer, K et al., "Estimating Frequency and Amplitude of Sinusoids in Harmonic Signals—A Survey and the Use of Shifted Fourier Transforms", Graz: Graz University of Technology; Graz University of Music and Dramatic Arts; Diploma Thesis, Apr. 2004, 111 pages.
Lanciani, C et al., "Subband-Domain Filtering of MPEG Audio Signals", 1999 IEEE International Conference on Acoustics, Speech, and Signal Processing. Phoenix, , AZ, USA., Mar. 15, 1999, pp. 917-920.
Lauber, P et al., "Error Concealment for Compressed Digital Audio", Presented at the 111th AES Convention. Paper 5460. New York, USA., Sep. 21, 2001, 12 Pages.
Lee, Ick Don et al., "A Voice Activity Detection Algorithm for Communication Systems with Dynamically Varying Background Acoustic Noise", Dept. of Electrical Engineering, 1998 IEEE, May 18-21, 1998, pp. 1214-1218.
Makinen, J et al., "AMR-WB+: a New Audio Coding Standard for 3rd Generation Mobile Audio Services", 2005 IEEE International Conference on Acoustics, Speech, and Signal Processing. Philadelphia, PA, USA., Mar. 18, 2005, 1109-1112.
Motlicek, P et al., "Audio Coding Based on Long Temporal Contexts", Rapport de recherche de l'IDIAP 06-30, Apr. 2006, pp. 1-10.
Neuendorf, M et al., "A Novel Scheme for Low Bitrate Unified Speech Audio Coding—MPEG RMO", AES 126th Convention. Convention Paper 7713. Munich, Germany, May 1, 2009, 13 Pages.
Neuendorf, M et al., "Completion of Core Experiment on unification of USAC Windowing and Frame Transitions", International Organisation for Standardisation Organisation Internationale De Normalisation ISO/IEC JTC1/SC29/WG11. Coding of Moving Pictures and Audio. Kyoto, Japan., Jan. 2010, 52 Pages.
Neuendorf, M et al., "Unified Speech and Audio Coding Scheme for High Quality at Low Bitrates", ICASSP 2009 IEEE International Conference on Acoustics, Speech and Signal Processing, Piscataway, NJ, USA., Apr. 19, 2009, 4 Pages.
Patwardhan, P et al., "Effect of Voice Quality on Frequency-Warped Modeling of Vowel Spectra", Speech Communication. vol. 48, No. 8., Aug. 2006, pp. 1009-1023.
Ryan, D et al., "Reflected Simplex Codebooks for Limited Feedback MIMO Beamforming", IEEE. XP31506379A., Jun. 14-18, 2009, 6 Pages.
Sjoberg, J et al., "RTP Payload Format for the Extended Adaptive Multi-Rate Wideband (AMR-WB+) Audio Codec", Memo. The Internet Society. Network Working Group. Category: Standards Track., Jan. 2006, pp. 1-38.
Terriberry, T et al., "A Multiply-Free Enumeration of Combinations with Replacement and Sign", IEEE Signal Processing Letters. vol. 15, 2008, 11 Pages.
Terriberry, T et al., "Pulse Vector Coding", Retrieved from the internet on Oct. 12, 2012. XP55025946. URL:http://people.xiph.org/~tterribe/notes/cwrs.html, Dec. 1, 2007, 4 Pages.
Virette, D et al., "Enhanced Pulse Indexing CE for ACELP in USAC", Organisation Internationale De Normalisation ISO/IEC JTC1/SC29/WG11. MPEG2012/M19305. Coding of Moving Pictures and Audio. Daegu, Korea., Jan. 2011, 13 Pages.
Wang, F et al., "Frequency Domain Adaptive Postfiltering for Enhancement of Noisy Speech", Speech Communication 12. Elsevier Science Publishers. Amsterdam, North-Holland. vol. 12, No. 1., Mar. 1993, 41-56.
Waterschoot, T et al., "Comparison of Linear Prediction Models for Audio Signals", EURASIP Journal on Audio, Speech, and Music Processing. vol. 21., Dec. 2008, 27 pages.
Zernicki, T et al., "Report on CE on Improved Tonal Component Coding in eSBR", International Organisation for Standardisation Organisation Internationale De Normalisation ISO/IEC JTC1/SC29/WG11. Coding of Moving Pictures and Audio. Daegu, South Korea, Jan. 2011, 20 Pages.
3GPP, TS 26.290 Version 9.0.0; Digital cellular telecommunications system (Phase 2+); Universal Mobile Telecommunications System (UMTS); LTE; Audio codec processing functions; Extended Adaptive Multi-Rate-Wideband (AMR-WB+) codec; Transcoding functions (3GPP TS 26.290 version 9.0.0 release 9), Jan. 2010, Chapter 5.3, pp. 24-39.
Britanak, et al., "A new fast algorithm for the unified forward and inverse MDCT/MDST computation", Signal Processing, vol. 82, Mar. 2002, pp. 433-459.
Herley, C. et al., "Tilings of the Time-Frequency Plane: Construction of Arbitrary Orthogonal Bases and Fast Tilings Algorithms", IEEE Transactions on Signal Processing, vol. 41, No. 12, Dec. 1993, pp. 3341-3359.
Lefebvre, R. et al., "High quality coding of wideband audio signals using transform coded excitation (TCX)", 1994 IEEE International Conference on Acoustics, Speech, and Signal Processing, Apr. 19-22, 1994, pp. I/193 to I/196 (4 pages).

* cited by examiner

APPARATUS AND METHOD FOR ERROR CONCEALMENT IN LOW-DELAY UNIFIED SPEECH AND AUDIO CODING

CROSS-REFERENCE TO RELATED APPLICATIONS

This application is a continuation of copending International Application No. PCT/EP2012/052395, filed Feb. 13, 2012, which is incorporated herein by reference in its entirety, and additionally claims priority from U.S. Application No. 61/442,632, filed Feb. 14, 2011, which is also incorporated herein by reference in its entirety.

The present invention relates to audio signal processing and, in particular, to an apparatus and method for error concealment in Low-Delay Unified Speech and Audio Coding (LD-USAC).

BACKGROUND OF THE INVENTION

Audio signal processing has advanced in many ways and becomes increasingly important. In audio signal processing, Low-Delay Unified Speech and Audio Coding aims to provide coding techniques suitable for speech, audio and any mixture of speech and audio. Moreover, LD-USAC aims to assure a high quality for the encoded audio signals. Compared to USAC (Unified Speech and Audio Coding), the delay in LD-USAC is reduced.

When encoding audio data, a LD-USAC encoder examines the audio signal to be encoded. The LD-USAC encoder encodes the audio signal by encoding linear predictive filter coefficients of a prediction filter. Depending on the audio data that is to be encoded by a particular audio frame, the LD-USAC encoder decides, whether ACELP (Advanced Code Excited Linear Prediction) is used for encoding, or whether the audio data is to be encoded using TCX (Transform Coded Excitation). While ACELP uses LP filter coefficients (linear predictive filter coefficients), adaptive codebook indices and algebraic codebook indices and adaptive and algebraic codebook gains, TCX uses LP filter coefficients, energy parameters and quantization indices relating to a Modified Discrete Cosine Transform (MDCT).

On the decoder side, the LD-USAC decoder determines whether ACELP or TCX has been employed to encode the audio data of a current audio signal frame. The decoder then decodes the audio signal frame accordingly.

From time to time, data transmission fails. For example, an audio signal frame transmitted by a sender is arriving with errors at a receiver or does not arrive at all or the frame is late.

In these cases, error concealment may become useful for ensuring that the missing or erroneous audio data can be replaced. This is particularly true for applications having real-time requirements, as requesting a retransmission of the erroneous or the missing frame might infringe low-delay requirements.

However, existing concealment techniques used for other audio applications often create artificial sound caused by synthetic artefacts.

SUMMARY

According to an embodiment, an apparatus for generating spectral replacement values for an audio signal may have: a buffer unit for storing previous spectral values relating to a previously received error-free audio frame, and a concealment frame generator for generating the spectral replacement values when a current audio frame has not been received or is erroneous, wherein the previously received error-free audio frame includes filter information, the filter information including an associated filter stability value indicating a stability of a prediction filter, and wherein the concealment frame generator is adapted to generate the spectral replacement values based on the previous spectral values and based on the filter stability value.

According to another embodiment, an audio signal decoder may have: an apparatus for decoding spectral audio signal values, and an apparatus for generating spectral replacement values according to claim 1, wherein the apparatus for decoding spectral audio signal values is adapted to decode spectral values of an audio signal based on a previously received error-free audio frame, wherein the apparatus for decoding spectral audio signal values is furthermore adapted to store the spectral values of the audio signal in the buffer unit of the apparatus for generating spectral replacement values, and wherein the apparatus for generating spectral replacement values is adapted to generate the spectral replacement values based on the spectral values stored in the buffer unit, when a current audio frame has not been received or is erroneous.

According to another embodiment, an audio signal decoder may have: a decoding unit for generating first intermediate spectral values based on a received error-free audio frame, a temporal noise shaping unit for conducting temporal noise shaping on the first intermediate spectral values to acquire second intermediate spectral values, a prediction gain calculator for calculating a prediction gain of the temporal noise shaping depending on the first intermediate spectral values and depending on the second intermediate spectral values, an apparatus according to claim 1, for generating spectral replacement values when a current audio frame has not been received or is erroneous, and a values selector for storing the first intermediate spectral values in the buffer unit of the apparatus for generating spectral replacement values, if the prediction gain is greater than or equal to a threshold value, or for storing the second intermediate spectral values in the buffer unit of the apparatus for generating spectral replacement values, if the prediction gain is smaller than the threshold value.

According to another embodiment, an audio signal decoder may have: a first decoding module for generating generated spectral values based on a received error-free audio frame, an apparatus for generating spectral replacement values according to claim 1, and a processing module for processing the generated spectral values by conducting temporal noise shaping, applying noise-filling or applying a global gain, to acquire spectral audio values of the decoded audio signal, wherein the apparatus for generating spectral replacement values is adapted to generate spectral replacement values and to feed them into the processing module, when a current frame has not been received or is erroneous.

According to another embodiment, a method for generating spectral replacement values for an audio signal may have the steps of: storing previous spectral values relating to a previously received error-free audio frame, and generating the spectral replacement values when a current audio frame has not been received or is erroneous, wherein the previously received error-free audio frame includes filter information, the filter information including an associated filter stability value indicating a stability of a prediction filter defined by the filter information, wherein the spectral replacement values are generated based on the previous spectral values and based on the filter stability value.

Another embodiment may have a computer program for implementing the method of claim 15, when the computer program is executed by a computer or signal processor.

An apparatus for generating spectral replacement values for an audio signal is provided. The apparatus comprises a buffer unit for storing previous spectral values relating to a previously received error-free audio frame. Moreover, the apparatus comprises a concealment frame generator for generating the spectral replacement values, when a current audio frame has not been received or is erroneous. The previously received error-free audio frame comprises filter information, the filter information having associated a filter stability value indicating a stability of a prediction filter. The concealment frame generator is adapted to generate the spectral replacement values based on the previous spectral values and based on the filter stability value.

The present invention is based on the finding that while previous spectral values of a previously received error-free frame may be used for error concealment, a fade out should be conducted on these values, and the fade out should depend on the stability of the signal. The less stable a signal is, the faster the fade out should be conducted.

In an embodiment, the concealment frame generator may be adapted to generate the spectral replacement values by randomly flipping the sign of the previous spectral values.

According to a further embodiment, the concealment frame generator may be configured to generate the spectral replacement values by multiplying each of the previous spectral values by a first gain factor when the filter stability value has a first value, and by multiplying each of the previous spectral values by a second gain factor being smaller than the first gain factor, when the filter stability value has a second value being smaller than the first value.

In another embodiment, the concealment frame generator may be adapted to generate the spectral replacement values based on the filter stability value, wherein the previously received error-free audio frame comprises first predictive filter coefficients of the prediction filter, wherein a predecessor frame of the previously received error-free audio frame comprises second predictive filter coefficients, and wherein the filter stability value depends on the first predictive filter coefficients and on the second predictive filter coefficients.

According to an embodiment, the concealment frame generator may be adapted to determine the filter stability value based on the first predictive filter coefficients of the previously received error-free audio frame and based on the second predictive filter coefficients of the predecessor frame of the previously received error-free audio frame.

In another embodiment, the concealment frame generator may be adapted to generate the spectral replacement values based on the filter stability value, wherein the filter stability value depends on a distance measure $LSF_{dist}$, and wherein the distance measure $LSF_{dist}$ is defined by the formula:

$$LSF_{dist} = \sum_{i=0}^{u} \left(f_i - f_i^{(p)}\right)^2$$

wherein u+1 specifies a total number of the first predictive filter coefficients of the previously received error-free audio frame, and wherein u+1 also specifies a total number of the second predictive filter coefficients of the predecessor frame of the previously received error-free audio frame, wherein $f_i$ specifies the i-th filter coefficient of the first predictive filter coefficients and wherein $f_i^{(p)}$ specifies the i-th filter coefficient of the second predictive filter coefficients.

According to an embodiment, the concealment frame generator may be adapted to generate the spectral replacement values furthermore based on frame class information relating to the previously received error-free audio frame. For example, the frame class information indicates that the previously received error-free audio frame is classified as "artificial onset", "onset", "voiced transition", "unvoiced transition", "unvoiced" or "voiced".

In another embodiment, the concealment frame generator may be adapted to generate the spectral replacement values furthermore based on a number of consecutive frames that did not arrive at a receiver or that were erroneous, since a last error-free audio frame had arrived at the receiver, wherein no other error-free audio frames arrived at the receiver since the last error-free audio frame had arrived at the receiver.

According to another embodiment, the concealment frame generator may be adapted to calculate a fade out factor and based on the filter stability value and based on the number of consecutive frames that did not arrive at the receiver or that were erroneous. Moreover, the concealment frame generator may be adapted to generate the spectral replacement values by multiplying the fade out factor by at least some of the previous spectral values, or by at least some values of a group of intermediate values, wherein each one of the intermediate values depends on at least one of the previous spectral values.

In a further embodiment, the concealment frame generator may be adapted to generate the spectral replacement values based on the previous spectral values, based on the filter stability value and also based on a prediction gain of a temporal noise shaping.

According to a further embodiment, an audio signal decoder is provided. The audio signal decoder may comprise an apparatus for decoding spectral audio signal values, and an apparatus for generating spectral replacement values according to one of the above-described embodiments. The apparatus for decoding spectral audio signal values may be adapted to decode spectral values of an audio signal based on a previously received error-free audio frame. Moreover, the apparatus for decoding spectral audio signal values may furthermore be adapted to store the spectral values of the audio signal in the buffer unit of the apparatus for generating spectral replacement values. The apparatus for generating spectral replacement values may be adapted to generate the spectral replacement values based on the spectral values stored in the buffer unit, when a current audio frame has not been received or is erroneous.

Moreover, an audio signal decoder according to another embodiment is provided. The audio signal decoder comprises a decoding unit for generating first intermediate spectral values based on a received error-free audio frame, a temporal noise shaping unit for conducting temporal noise shaping on the first intermediate spectral values to obtain second intermediate spectral values, a prediction gain calculator for calculating a prediction gain of the temporal noise shaping depending on the first intermediate spectral values and depending on the second intermediate spectral values, an apparatus according to one of the above-described embodiments for generating spectral replacement values when a current audio frame has not been received or is erroneous, and a values selector for storing the first intermediate spectral values in the buffer unit of the apparatus for generating spectral replacement values, if the prediction gain is greater than or equal to a threshold value, or for storing the second intermediate spectral values in the buffer unit of the apparatus for generating spectral replacement values, if the prediction gain is smaller than the threshold value.

Furthermore, another audio signal decoder is provided according to another embodiment. The audio signal decoder comprises a first decoding module for generating generated spectral values based on a received error-free audio frame, an apparatus for generating spectral replacement values according to one of the above-described embodiments, a processing module for processing the generated spectral values by conducting temporal noise shaping, applying noise-filling and/or applying a global gain, to obtain spectral audio values of the decoded audio signal. The apparatus for generating spectral replacement values may be adapted to generate spectral replacement values and to feed them into the processing module when a current frame has not been received or is erroneous.

BRIEF DESCRIPTION OF THE DRAWINGS

Embodiments of the present invention will be detailed subsequently referring to the appended drawings, in which.

DETAILED DESCRIPTION OF THE INVENTION

Figure 1:
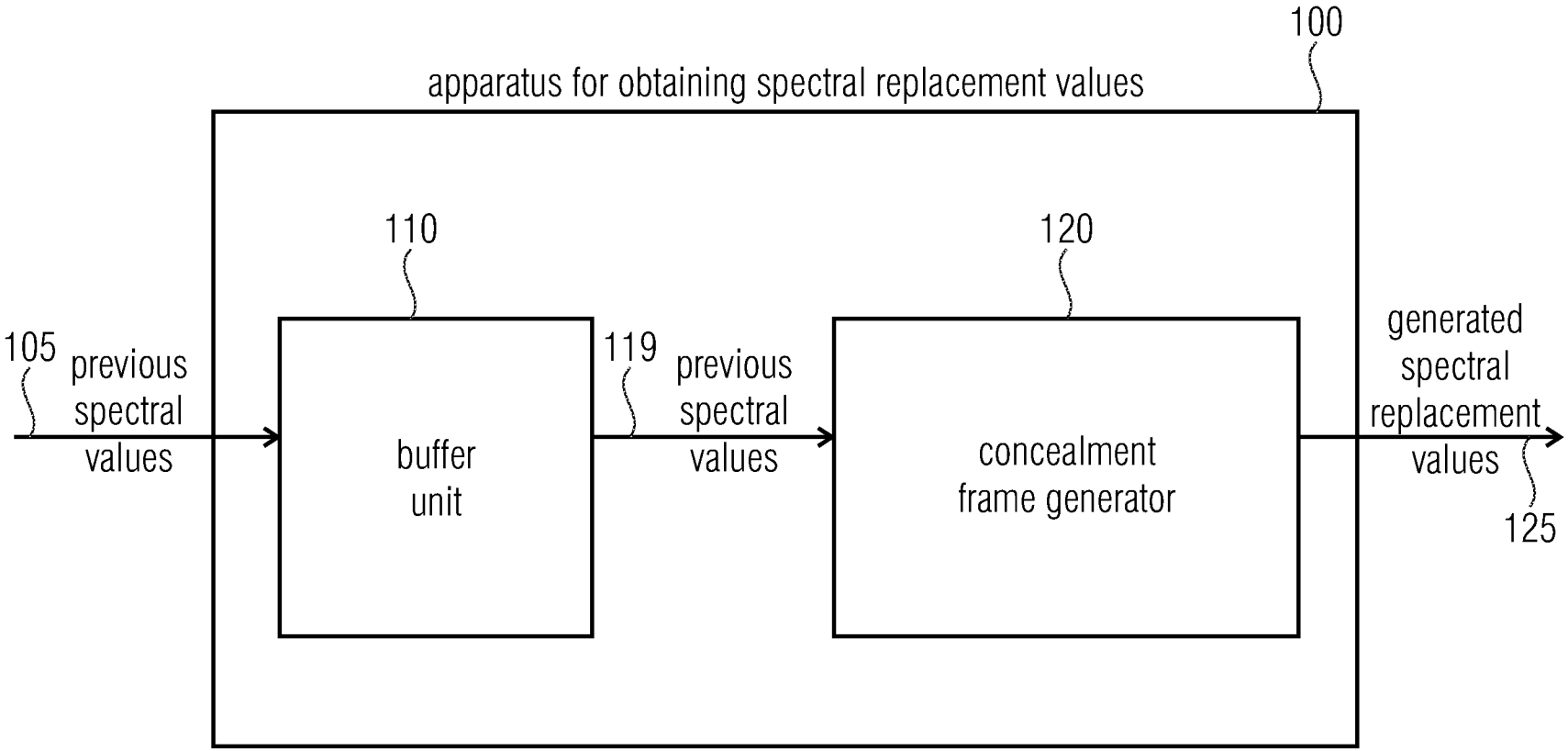
FIG. 1 illustrates an apparatus for obtaining spectral replacement values for an audio signal according to an embodiment.

FIG. 1 illustrates an apparatus 100 for generating spectral replacement values for an audio signal. The apparatus 100 comprises a buffer unit 110 for storing previous spectral values relating to a previously received error-free audio frame. Moreover, the apparatus 100 comprises a concealment frame generator 120 for generating the spectral replacement values, when a current audio frame has not been received or is erroneous. The previously received error-free audio frame comprises filter information, the filter information having associated a filter stability value indicating a stability of a prediction filter. The concealment frame generator 120 is adapted to generate the spectral replacement values based on the previous spectral values and based on the filter stability value.

The previously received error-free audio frame may, for example, comprise the previous spectral values. E.g. the previous spectral values may be comprised in the previously received error-free audio frame in an encoded form.

Or, the previous spectral values may, for example, be values that may have been generated by modifying values comprised in the previously received error-free audio frame, e.g. spectral values of the audio signal. For example, the values comprised in the previously received error-free audio frame may have been modified by multiplying each one of them with a gain factor to obtain the previous spectral values.

Or, the previous spectral values may, for example, be values that may have been generated based on values comprised in the previously received error-free audio frame. For example, each one of the previous spectral values may have been generated by employing at least some of the values comprised in the previously received error-free audio frame, such that each one of the previous spectral values depends on at least some of the values comprised in the previously received error-free audio frame. E.g., the values comprised in the previously received error-free audio frame may have been used to generate an intermediate signal. For example, the spectral values of the generated intermediate signal may then be considered as the previous spectral values relating to the previously received error-free audio frame.

Arrow 105 indicates that the previous spectral values are stored in the buffer unit 110.

The concealment frame generator 120 may generate the spectral replacement values, when a current audio frame has not been received in time or is erroneous. For example, a transmitter may transmit a current audio frame to a receiver, where the apparatus 100 for obtaining spectral replacement values, may for example be located. However, the current audio frame does not arrive at the receiver, e.g. because of any kind of transmission error. Or, the transmitted current audio frame is received by the receiver, but, for example, because of a disturbance, e.g. during transmission, the current audio frame is erroneous. In such or other cases, the concealment frame generator 120 is needed for error concealment.

For this, the concealment frame generator 120 is adapted to generate the spectral replacement values based on at least some of the previous spectral values, when a current audio frame has not been received or is erroneous. According to embodiments, it is assumed that the previously received error-free audio frame comprises filter information, the filter information having associated a filter stability value indicating a stability of a prediction filter defined by the filter information. For example, the audio frame may comprise predictive filter coefficients, e.g. linear predictive filter coefficients, as filter information.

The concealment frame generator 120 is furthermore adapted to generate the spectral replacement values based on the previous spectral values and based on the filter stability value.

For example, the spectral replacement values may be generated based on the previous spectral values and based on the filter stability value in that each one of the previous spectral values are multiplied by a gain factor, wherein the value of the gain factor depends on the filter stability value. E.g., the gain factor may be smaller in a second case than in a first case, when the filter stability value in the second case is smaller than in the first case.

According to another embodiment, the spectral replacement values may be generated based on the previous spectral values and based on the filter stability value. Intermediate values may be generated by modifying the previous spectral values, for example, by randomly flipping the sign of the previous spectral values, and by multiplying each one of the intermediate values by a gain factor, wherein the value of the gain factor depends on the filter stability value. For example, the gain factor may be smaller in a second case than in a first case, when the filter stability value in the second case is smaller than in the first case.

According to a further embodiment, the previous spectral values may be employed to generate an intermediate signal, and a spectral domain synthesis signal may be generated by applying a linear prediction filter on the intermediate signal. Then, each spectral value of the generated synthesis signal may be multiplied by a gain factor, wherein the value of the gain factor depends on the filter stability value. As above, the gain factor may, for example, be smaller in a second case than in a first case, if the filter stability value in the second case is smaller than in the first case.

Figure 2:
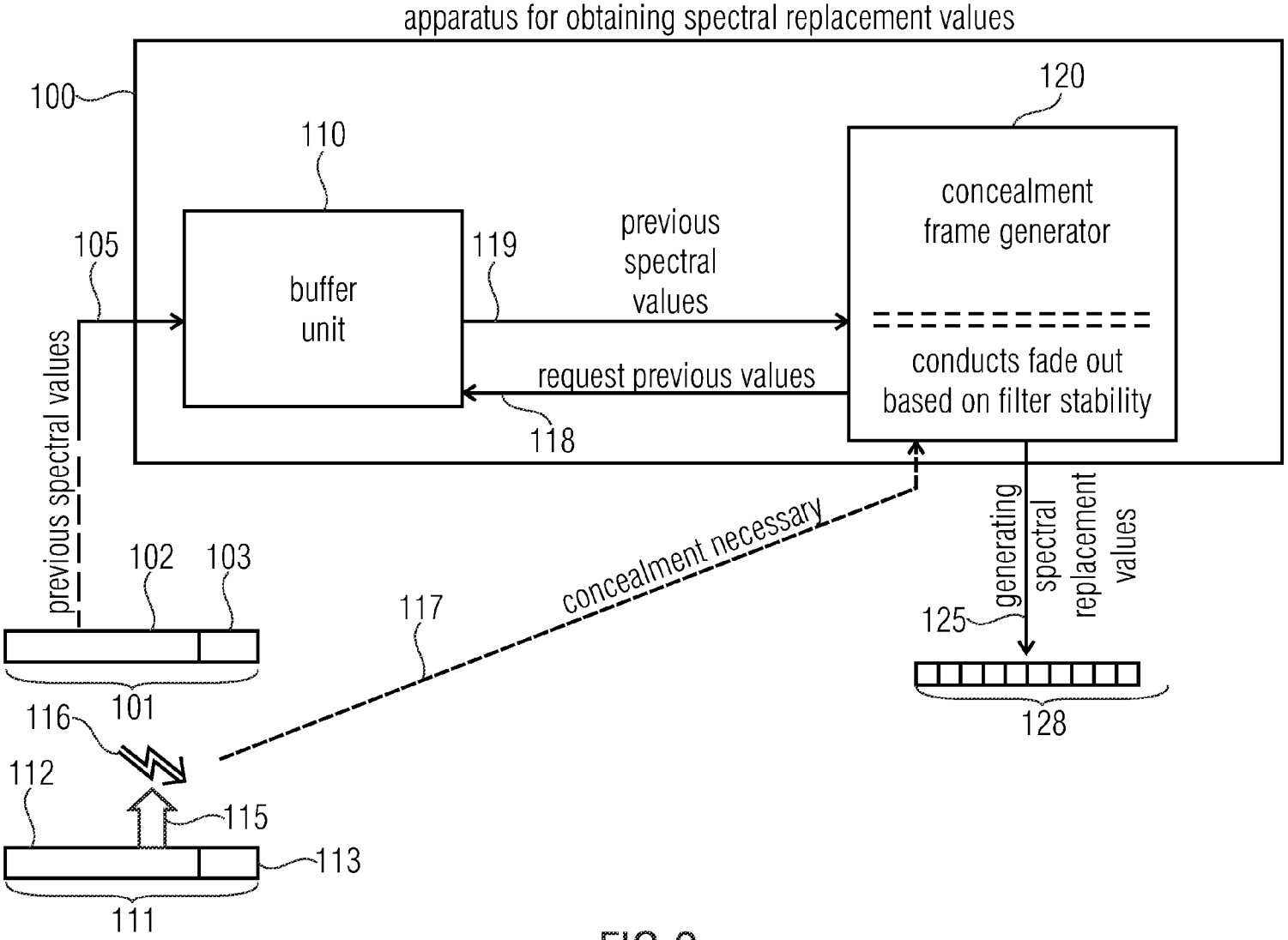
FIG. 2 illustrates an apparatus for obtaining spectral replacement values for an audio signal according to another embodiment.

A particular embodiment illustrated in FIG. 2 is now explained in detail. A first frame 101 arrives at a receiver side, where an apparatus 100 for obtaining spectral replacement values may be located. On the receiver side, it is checked, whether the audio frame is error-free or not. For example, an error-free audio frame is an audio frame where all the audio data comprised in the audio frame is error-free. For this purpose, means (not shown) may be employed on the receiver side, which determine, whether a received frame is error-free or not. To this end, state-of-the art error recognition techniques may be employed, such as means which test, whether the received audio data is consistent with a received check bit or a received check sum. Or, the error-detecting means may employ a cyclic redundancy check (CRC) to test whether the received audio data is consistent with a received CRC-value. Any other technique for testing, whether a received audio frame is error-free or not, may also be employed.

The first audio frame 101 comprises audio data 102. Moreover, the first audio frame comprises check data 103. For example, the check data may be a check bit, a check sum or a CRC-value, which may be employed on the receiver side to test whether the received audio frame 101 is error-free (is an error-free frame) or not.

If it has been determined that the audio frame 101 is error-free, then, values relating to the error-free audio frame, e.g. to the audio data 102, will be stored in the buffer unit 110 as "previous spectral values". These values may, for example, be spectral values of the audio signal encoded in the audio frame. Or, the values that are stored in the buffer unit may, for example, be intermediate values resulting from processing and/or modifying encoded values stored in the audio frame. Alternatively, a signal, for example a synthesis signal in the spectral domain, may be generated based on encoded values of the audio frame, and the spectral values of the generated signal may be stored in the buffer unit 110. Storing the previous spectral values in the buffer unit 110 is indicated by arrow 105.

Moreover, the audio data 102 of the audio frame 101 is used on the receiver side to decode the encoded audio signal (not shown). The part of the audio signal that has been decoded may then be replayed on a receiver side.

Subsequently after processing audio frame 101, the receiver side expects the next audio frame 111 (also comprising audio data 112 and check data 113) to arrive at the receiver side. However, e.g., while the audio frame 111 is transmitted (as shown in 115), something unexpected happens. This is illustrated by 116. For example, a connection may be disturbed such that bits of the audio frame 111 may be unintentionally modified during transmission, or, e.g., the audio frame 111 may not arrive at all at a receiver side.

In such a situation, concealment is needed. When, for example, an audio signal is replayed on a receiver side that is generated based on a received audio frame, techniques should be employed that mask a missing frame. For example, concepts should define what to do, when a current audio frame of an audio signal that is needed for play back, does not arrive at the receiver side or is erroneous.

The concealment frame generator 120 is adapted to provide error concealment. In FIG. 2, the concealment frame generator 120 is informed that a current frame has not been received or is erroneous. On the receiver side, means (not shown) may be employed to indicate to the concealment frame generator 120 that concealment may be used (this is shown by dashed arrow 117).

To conduct error concealment, the concealment frame generator 120 may request some or all of the previous spectral values, e.g. previous audio values, relating to the previously received error-free frame 101 from the buffer unit 110. This request is illustrated by arrow 118. As in the example of FIG. 2, the previously received error-free frame may, for example, be the last error-free frame received, e.g. audio frame 101. However, a different error-free frame may also be employed on the receiver side as previously received error-free frame.

The concealment frame generator then receives (some or all of) the previous spectral values relating to the previously received error-free audio frame (e.g. audio frame 101) from the buffer unit 110, as shown in 119. E.g., in case of multiple frame loss, the buffer is updated either completely or partly. In an embodiment, the steps illustrated by arrows 118 and 119 may be realized in that the concealment frame generator 120 loads the previous spectral values from the buffer unit 110.

The concealment frame generator 120 then generates spectral replacement values based on at least some of the previous spectral values. By this, the listener should not become aware that one or more audio frames are missing, such that the sound impression created by the play back is not disturbed.

A simple way to achieve concealment would be, to simply use the values, e.g. the spectral values of the last error-free frame as spectral replacement values for the missing or erroneous current frame.

However, particular problems exist especially in case of onsets, e.g., when the sound volume suddenly changes significantly. For example, in case of a noise burst, by simply repeating the previous spectral values of the last frame, the noise burst would also be repeated.

In contrast, if the audio signal is quite stable, e.g. its volume does not change significantly, or, e.g. its spectral values do not change significantly, then the effect of artificially generating the current audio signal portion based on the previously received audio data, e.g., repeating the previously received audio signal portion, would be less disturbing for a listener.

Embodiments are based on this finding. The concealment frame generator 120 generates spectral replacement values based on at least some of the previous spectral values and based on the filter stability value indicating a stability of a prediction filter relating to the audio signal. Thus, the concealment frame generator 120 takes the stability of the audio signal into account, e.g. the stability of the audio signal relating to the previously received error-free frame.

For this, the concealment frame generator 120 might change the value of a gain factor that is applied on the previous spectral values. For example, each of the previous spectral values is multiplied by the gain factor. This is illustrated with respect to FIGS. 3*a*-3*c*.

Figure 3A:
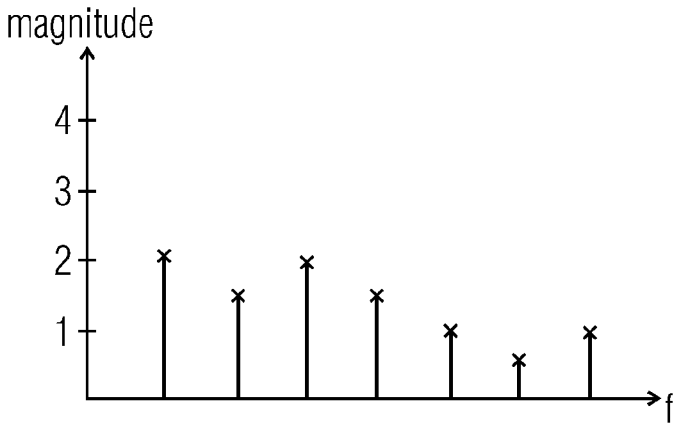
FIGS. 3*a*-3*c* illustrate the multiplication of a gain factor and previous spectral values according to an embodiment.

In FIG. 3*a*, some of the spectral lines of an audio signal relating to a previously received error-free frame are illustrated before an original gain factor is applied. For example, the original gain factor may be a gain factor that is transmitted in the audio frame. On the receiver side, if the received frame is error-free, the decoder may, for example, be configured to multiply each of the spectral values of the audio signal by the original gain factor g to obtain a modified spectrum. This is shown in FIG. 3*b*.

Figure 3B:
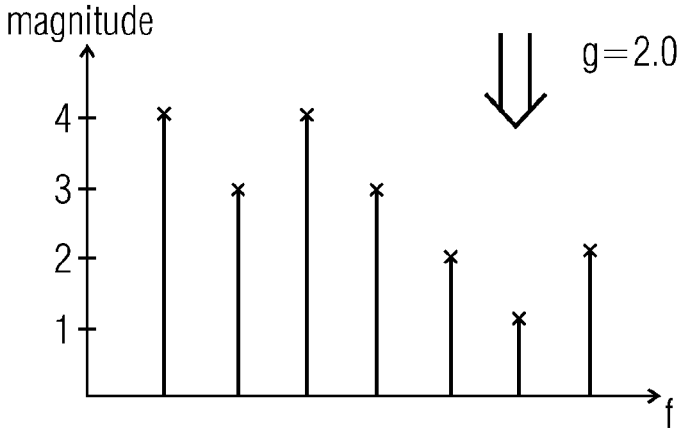

In FIG. 3*b*, spectral lines that result from multiplying the spectral lines of FIG. 3*a* by an original gain factor are depicted. For reasons of simplicity it is assumed that the original gain factor g is 2.0. (g=2.0). FIGS. 3*a* and 3*b* illustrate a scenario, where no concealment may have been used.

Figure 3C:
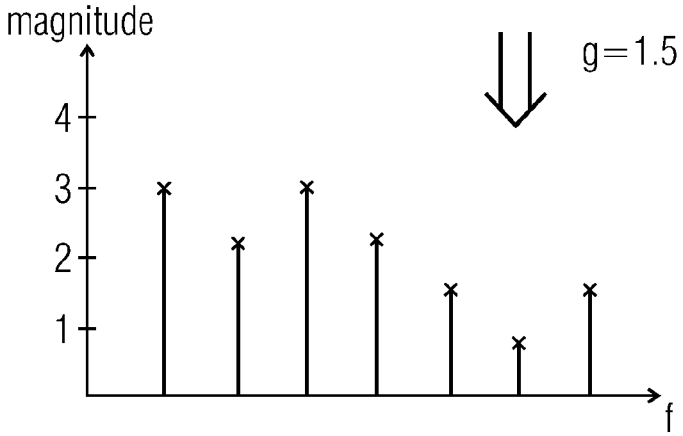

In FIG. 3*c*, a scenario is assumed, where a current frame has not been received or is erroneous. In such a case, replacement vectors have to be generated. For this, the previous spectral values relating to the previously received error-free frame, that have been stored in a buffer unit may be used for generating the spectral replacement values.

In the example of FIG. 3*c*, it is assumed that the spectral replacement values are generated based on the received values, but the original gain factor is modified.

A different, smaller, gain factor is used to generate the spectral replacement values than the gain factor that is used to amplify the received values in the case of FIG. 3*b*. By this, a fade out is achieved.

For example, the modified gain factor used in the scenario illustrated by FIG. 3*c* may be 75% of the original gain factor, e.g. 0.75-2.0=1.5. By multiplying each of the spectral values by the (reduced) modified gain factor, a fade out is conducted, as the modified gain factor $g_{act}$=1.5 that is used for multiplication of the each one of the spectral values is smaller than the original gain factor (gain factor $g_{prev}$=2.0) used for multiplication of the spectral values in the error-free case.

Figure 4A:
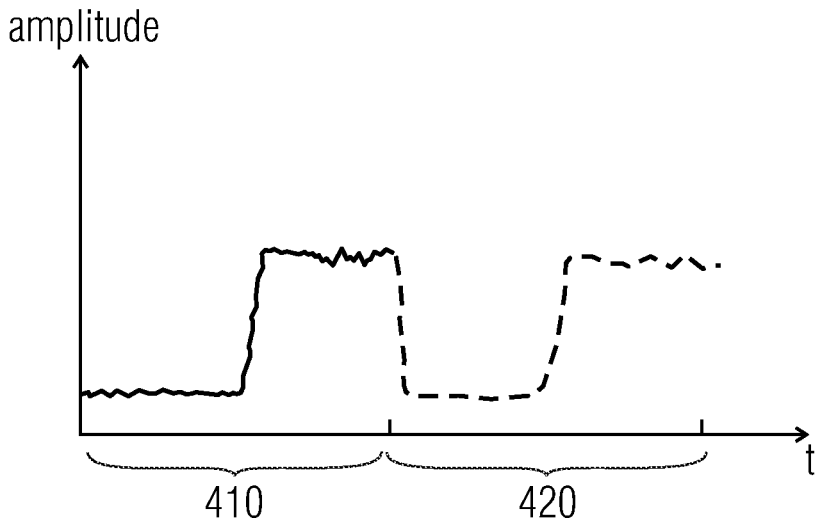
FIG. 4*a* illustrates the repetition of a signal portion which comprises an onset in a time domain.

The present invention is inter alia based on the finding, that repeating the values of a previously received error-free frame is perceived as more disturbing, when the respective audio signal portion is unstable, then in the case, when the respective audio signal portion is stable. This is illustrated in FIGS. 4*a* and 4*b*.

For example, if the previously received error-free frame comprises an onset, then the onset is likely to be reproduced. FIG. 4*a* illustrates an audio signal portion, wherein a transient occurs in the audio signal portion associated with the last received error-free frame. In FIGS. 4*a* and 4*b*, the abscissa indicates time, the ordinate indicates an amplitude value of the audio signal.

The signal portion specified by 410 relates to the audio signal portion relating to the last received error-free frame. The dashed line in area 420 indicates a possible continuation of the curve in the time domain, if the values relating to the previously received error-free frame would simply be copied and used as spectral replacement values of a replacement frame. As can be seen, the transient is likely to be repeated what may be perceived as disturbing by the listener.

Figure 4B:
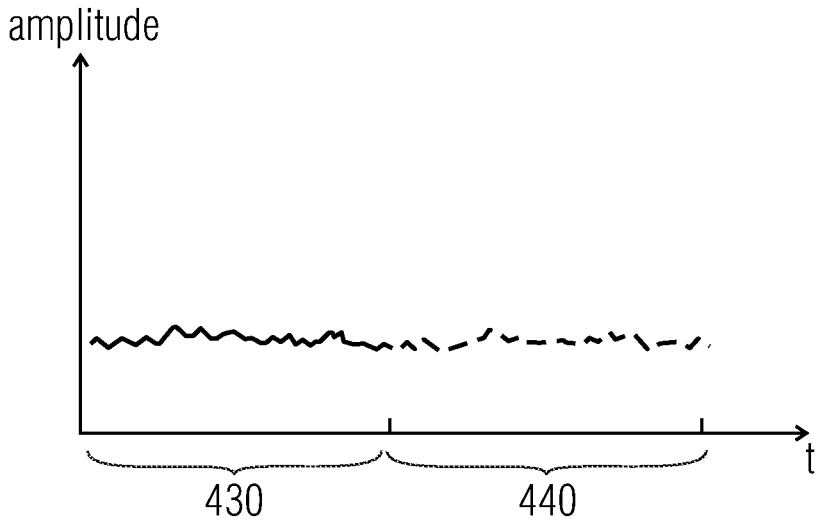
FIG. 4*b* illustrates the repetition of a stable signal portion in a time domain.

In contrast, FIG. 4*b* illustrates an example, where the signal is quite stable. In FIG. 4*b*, an audio signal portion relating to the last received error-free frame is illustrated. In the signal portion of FIG. 4*b*, no transient occurred. Again, the abscissa indicates time, the ordinate indicates an amplitude of the audio signal. The area 430 relates to the signal portion associated with the last received error-free frame. The dashed line in area 440 indicates a possible continuation of the curve in the time domain, if the values of the previously received error-free frame would be copied and used as spectral replacement values of a replacement frame. In such situations where the audio signal is quite stable, repeating the last signal portion appears to be more acceptable for a listener than in the situation where an onset is repeated, as illustrated in FIG. 4*a*.

The present invention is based on the finding that spectral replacement values may be generated based on previously received values of a previous audio frame, but that also the stability of a prediction filter depending on the stability of an audio signal portion should be considered. For this, a filter stability value should be taken into account. The filter stability value may, e.g., indicate the stability of the prediction filter.

In LD-USAC, the prediction filter coefficients, e.g. linear prediction filter coefficients, may be determined on an encoder side and may be transmitted to the receiver within the audio frame.

On the decoder side, the decoder then receives the predictive filter coefficients, for example, the predictive filter coefficients of the previously received error-free frame. Moreover, the decoder may have already received the predictive filter coefficients of the predecessor frame of the previously received frame, and may, e.g., have stored these predictive filter coefficients. The predecessor frame of the previously received error-free frame is the frame that immediately precedes the previously received error-free frame. The concealment frame generator may then determine the filter stability value based on the predictive filter coefficients of the previously received error-free frame and based on the predictive filter coefficients of the predecessor frame of the previously received error-free frame.

In the following, determination of the filter stability value according an embodiment is presented, which is particularly suitable for LD-USAC. The stability value considered depends on predictive filter coefficients, for example, 10 predictive filter coefficients $f_i$ in case of narrowband, or, for example, 16 predictive filter coefficients $f_i$ in case of wideband, which may have been transmitted in a previously received error-free frame. Moreover, predictive filter coefficients of the predecessor frame of the previously received error-free frame are also considered, for example 10 further predictive filter coefficients $f_i^{(p)}$ in case of narrowband (or, for example, 16 further predictive filter coefficients $f_i^{(p)}$ in case of wideband).

For example, the k-th prediction filter $f_k$ may have been calculated on an encoder side by computing an autocorrelation, such that:

$$f_k = \sum_{n=k}^{t} s'(n)s'(n-k)$$

wherein s' is a windowed speech signal, e.g. the speech signal that shall be encoded, after a window has been applied on the speech signal. t may for example be 383. Alternatively, t may have other values, such as 191 or 95.

In other embodiments, instead of computing an autocorrelation, the Levinson-Durbin-algorithm, known from the state of the art, may alternatively be employed, see, for example,

[3]: 3GPP, "Speech codec speech processing functions; Adaptive Multi-Rate—Wideband (AMR-WB) speech codec; Transcoding functions", 2009, V9.0.0, 3GPP TS 26.190.

As already stated, the predictive filter coefficients $f_i$ and $f_i^{(p)}$ may have been transmitted to the receiver within the previously received error-free frame and the predecessor of the previously received error-free frame, respectively.

On the decoder side, a Line Spectral Frequency distance measure (LSF distance measure) $LSF_{dist}$ may then be calculated employing the formula:

$$LSF_{dist} = \sum_{i=0}^{u} \left(f_i - f_i^{(p)}\right)^2$$

u may be the number of prediction filters in the previously received error-free frame minus 1. E.g. if the previously received error-free frame had 10 predictive filter coefficients, then, for example, u=9. The number of predictive filter coefficients in the previously received error-free frame is typically identical to the number of predictive filter coefficients in the predecessor frame of the previously received error-free frame.

The stability value may then be calculated according to the formula:

$$\theta=0 \text{ if } (1.25-LSF_{dist}/v)<0$$

$$\theta=1 \text{ if } (1.25-LSF_{dist}/v)>1$$

$$\theta=1.25-LSF_{dist}/v \quad 0\leq(1.25-LSF_{dist}/v)\leq 1$$

v may be an integer. For example, v may be 156250 in case of narrowband. In another embodiment, v may be 400000 in case of wideband.

θ is considered to indicate a very stable prediction filter, if θ is 1 or close to 1.

θ is considered to indicate a very unstable prediction filter, if θ is 0 or close to 0.

The concealment frame generator may be adapted to generate the spectral replacement values based on previous spectral values of a previously received error-free frame, when a current audio frame has not been received or is erroneous. Moreover, the concealment frame generator may be adapted to calculate a stability value θ based on the predictive filter coefficients $f_i$ of the previously received error-free frame and also based on the predictive filter coefficients $f_i^{(p)}$ of the previously received error-free frame, as has been described above.

In an embodiment, the concealment frame generator may be adapted to use the filter stability value to generate a generated gain factor, e.g. by modifying an original gain factor, and to apply the generated gain factor on the previous spectral values relating to the audio frame to obtain the spectral replacement values. In other embodiments, the concealment frame generator is adapted to apply the generated gain factor on values derived from the previous spectral values.

For example, the concealment frame generator may generate the modified gain factor by multiplying a received gain factor by a fade out factor, wherein the fade out factor depends on the filter stability value.

Let us, for example, assume that a gain factor received in an audio signal frame has, e.g. the value 2.0. The gain factor is typically used for multiplying the previous spectral values to obtain modified spectral values. To apply a fade out, a modified gain factor is generated that depends on the stability value θ.

For example, if the stability value θ=1, then the prediction filter is considered to be very stable. The fade out factor may then be set to 0.85, if the frame that shall be reconstructed is the first frame missing. Thus, the modified gain factor is 0.85-2.0=1.7. Each one of the received spectral values of the previously received frame is then multiplied by a modified gain factor of 1.7 instead of 2.0 (the received gain factor) to generate the spectral replacement values.

Figure 5A:
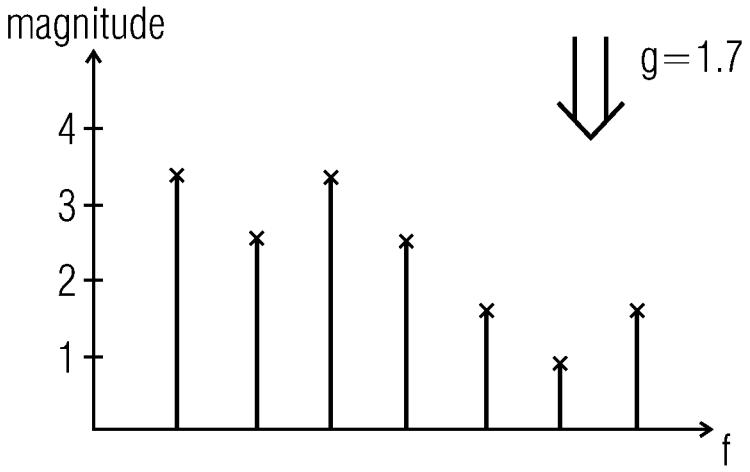
FIGS. 5*a*-5*b* illustrate examples, where generated gain factors are applied on the spectral values of FIG. 3*a*, according to an embodiment.

FIG. 5*a* illustrates an example, where a generated gain factor 1.7 is applied on the spectral values of FIG. 3*a*.

However, if, for example, the stability value θ=0, then the prediction filter is considered to be very unstable. The fade out factor may then be set to 0.65, if the frame that shall be reconstructed is the first frame missing. Thus, the modified gain factor is 0.65−2.0=1.3. Each one of the received spectral values of the previously received frame is then multiplied by a modified gain factor of 1.3 instead of 2.0 (the received gain factor) to generate the spectral replacement values.

Figure 5B:
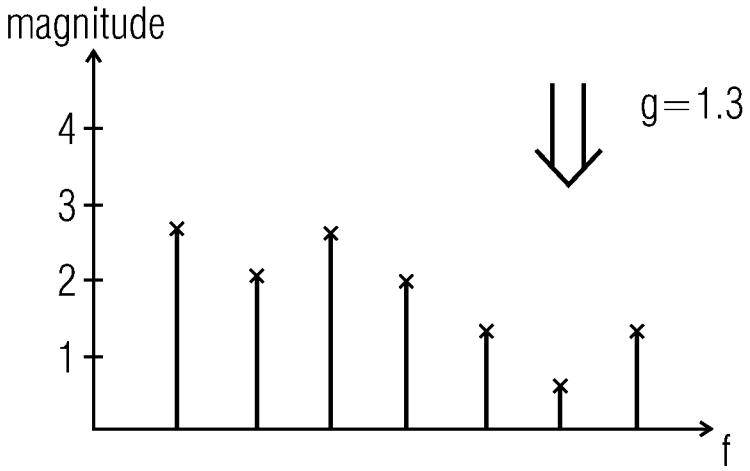

FIG. 5*b* illustrates an example, where a generated gain factor 1.3 is applied on the spectral values of FIG. 3*a*. As the gain factor in the example of FIG. 5*b* is smaller than in the example of FIG. 5*a*, the magnitudes in FIG. 5*b* are also smaller than in the example of FIG. 5*a*.

Different strategies may be applied depending on the value θ, wherein θ might be any value between 0 and 1.

For example, a value θ≥0.5 may be interpreted as 1 such that the fade out factor has the same value as if θ would be 1, e.g. the fade out factor is 0.85. A value θ<0.5 may be interpreted as 0 such that the fade out factor has the same value as if θ would be 0, e.g. the fade out factor is 0.65.

According to another embodiment, the value of the fade out factor might alternatively be interpolated, if the value of θ is between 0 and 1. For example, assuming that the value of the fade out factor is 0.85 if θ is 1, and 0.65 if θ is 0, then the fade out factor may be calculated according to the formula:

$$\text{fade_out_factor}=0.65+\theta\cdot 0.2;\ \text{for } 0<\theta<1.$$

In another embodiment, the concealment frame generator is adapted to generate the spectral replacement values furthermore based on frame class information relating to the previously received error-free frame. The information about the class may be determined by an encoder. The encoder may then encode the frame class information in the audio frame. The decoder might then decode the frame class information when decoding the previously received error-free frame.

Alternatively, the decoder may itself determine the frame class information by examining the audio frame.

Moreover, the decoder may be configured to determine the frame class information based on information from the encoder and based on an examination of the received audio data, the examination being conducted by the decoder, itself.

The frame class may, for example indicate whether the frame is classified as "artificial onset", "onset", "voiced transition", unvoiced transition", "unvoiced" and "voiced.

For example, "onset" might indicate that the previously received audio frame comprises an onset. E.g., "voiced" might indicate that the previously received audio frame comprises voiced data. For example, "unvoiced" might indicate that the previously received audio frame comprises unvoiced data. E.g., "voiced transition" might indicate that the previously received audio frame comprises voiced data, but that, compared to the predecessor of the previous received audio frame, the pitch did change. For example, "artificial onset" might indicate that the energy of the previously received audio frame has been enhanced (thus, for example, creating an artificial onset). E.g. "unvoiced transition" might indicate that the previously received audio frame comprises unvoiced data but that the unvoiced sound is about to change.

Depending on the previously received audio frame, the stability value θ and the number of successive erased frames, the attenuation gain, e.g. the fade out factor, may, for example, be defined as follows:

| Last good received frame | Number of successive erased frames | Attenuation gain (e.g. fade out factor) |
|---|---|---|
| ARTIFICIAL ONSET | | 0.6 |
| ONSET | ≤3 | 0.2 · θ + 0.8 |
| ONSET | >3 | 0.5 |
| VOICED TRANSITION | | 0.4 |
| UNVOICED TRANSITION | >1 | 0.8 |
| UNVOICED TRANSITION | =1 | 0.2 · θ + 0.75 |
| UNVOICED | =2 | 0.2 · θ + 0.6 |
| UNVOICED | >2 | 0.2 · θ + 0.4 |

-continued

| Last good received frame | Number of successive erased frames | Attenuation gain (e.g. fade out factor) |
|---|---|---|
| UNVOICED | =1 | $0.2 \cdot \theta + 0.8$ |
| VOICED | =2 | $0.2 \cdot \theta + 0.65$ |
| VOICED | >2 | $0.2 \cdot \theta + 0.5$ |

According to an embodiment, the concealment frame generator may generate a modified gain factor by multiplying a received gain factor by the fade out factor determined based on the filter stability value and on the frame class. Then, the previous spectral values may, for example, be multiplied by the modified gain factor to obtain spectral replacement values.

The concealment frame generator may again be adapted to generate the spectral replacement values furthermore also based on the frame class information.

According to an embodiment, the concealment frame generator may be adapted to generate the spectral replacement values furthermore depending on the number of consecutive frames that did not arrive at the receiver or that were erroneous.

In an embodiment, the concealment frame generator may be adapted to calculate a fade out factor based on the filter stability value and based on the number of consecutive frames that did not arrive at the receiver or that were erroneous.

The concealment frame generator may moreover be adapted to generate the spectral replacement values by multiplying the fade out factor by at least some of the previous spectral values.

Alternatively, the concealment frame generator may be adapted to generate the spectral replacement values by multiplying the fade out factor by at least some values of a group of intermediate values. Each one of the intermediate values depends on at least one of the previous spectral values. For example, the group of intermediate values may have been generated by modifying the previous spectral values. Or, a synthesis signal in the spectral domain may have been generated based on the previous spectral values, and the spectral values of the synthesis signal may form the group of intermediate values.

In another embodiment, the fade out factor may be multiplied by an original gain factor to obtain a generated gain factor. The generated gain factor is then multiplied by at least some of the previous spectral values, or by at least some values of the group of intermediate values mentioned before, to obtain the spectral replacement values.

The value of the fade out factor depends on the filter stability value and on the number of consecutive missing or erroneous frames, and may, for example, have the values:

| Filter stability value | Number of consecutive missing/erroneous frames | Fade out factor |
|---|---|---|
| 0 | 1 | 0.8 |
| 0 | 2 | $0.8 \cdot 0.65 = 0.52$ |
| 0 | 3 | $0.52 \cdot 0.55 = 0.29$ |
| 0 | 4 | $0.29 \cdot 0.55 = 0.16$ |
| 0 | 5 | $0.16 \cdot 0.55 = 0.09$ |
| ... | ... | ... |

Here, "Number of consecutive missing/erroneous frames=1" indicates that the immediate predecessor of the missing/erroneous frame was error-free.

As can be seen, in the above example, the fade out factor may be updated each time a frame does not arrive or is erroneous based on the last fade out factor. For example, if the immediate predecessor of a missing/erroneous frame is error-free, then, in the above example, the fade out factor is 0.8. If the subsequent frame is also missing or erroneous, the fade out factor is updated based on the previous fade out factor by multiplying the previous fade out factor by an update factor 0.65: fade out factor=0.8-0.65=0.52, and so on.

Some or all of the previous spectral values may be multiplied by the fade out factor itself.

Alternatively, the fade out factor may be multiplied by an original gain factor to obtain a generated gain factor. The generated gain factor may then be multiplied by each one (or some) of the previous spectral values (or intermediate values derived from the previous spectral values) to obtain the spectral replacement values.

It should be noted, that the fade out factor may also depend on the filter stability value. For example, the above table may also comprise definitions for the fade out factor, if the filter stability value is 1.0, 0.5 or any other value, for example:

| Filter stability value | Number of consecutive missing/erroneous frames | Fade out factor |
|---|---|---|
| 1.0 | 1 | 1.0 |
| 1.0 | 2 | $1.0 \cdot 0.85 = 0.85$ |
| 1.0 | 3 | $0.85 \cdot 0.75 = 0.64$ |
| 1.0 | 4 | $0.64 \cdot 0.75 = 0.48$ |
| 1.0 | 5 | $0.48 \cdot 0.75 = 0.36$ |
| ... | ... | ... |

Fade out factor values for intermediate filter stability values may be approximated.

In another embodiment, the fade out factor may be determined by employing a formula which calculates the fade out factor based on the filter stability value and based on the number of consecutive frames that did not arrive at the receiver or that were erroneous.

As has been described above, the previous spectral values stored in the buffer unit may be spectral values. To avoid that disturbing artefacts are generated, the concealment frame generator may, as explained above, generate the spectral replacement values based on a filter stability value.

However, the such generated signal portion replacement may still have a repetitive character. Therefore, according to an embodiment, it is moreover proposed to modify the previous spectral values, e.g. the spectral values of the previously received frame, by randomly flipping the sign of the spectral values. E.g. the concealment frame generator decides randomly for each of the previous spectral values, whether the sign of the spectral value is inverted or not, e.g. whether the spectral value is multiplied by −1 or not. By this, the repetitive character of the replaced audio signal frame with respect to its predecessor frame is reduced.

In the following, a concealment in a LD-USAC decoder according to an embodiment is described. In this embodiment, concealment is working on the spectral data just before the LD-USAC-decoder conducts the final frequency to time conversion.

In such an embodiment, the values of an arriving audio frame are used to decode the encoded audio signal by generating a synthesis signal in the spectral domain. For this, an intermediate signal in the spectral domain is generated based on the values of the arriving audio frame. Noise filling is conducted on the values quantized to zero.

The encoded predictive filter coefficients define a prediction filter which is then applied on the intermediate signal to generate the synthesis signal representing the decoded/reconstructed audio signal in the frequency domain.

Figure 6:
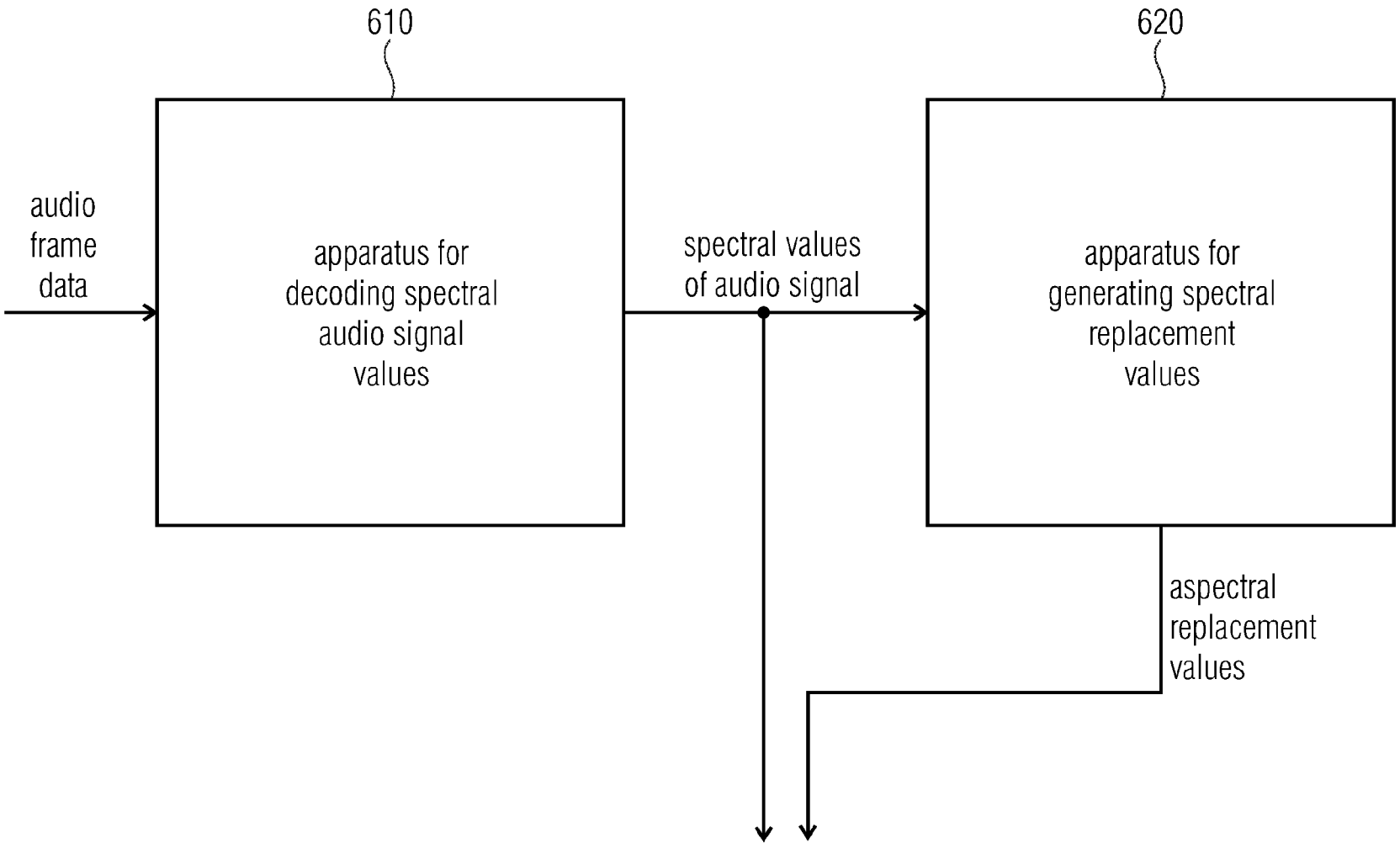
FIG. 6 illustrates an audio signal decoder according to an embodiment.

FIG. 6 illustrates an audio signal decoder according to an embodiment. The audio signal decoder comprises an apparatus for decoding spectral audio signal values 610, and an apparatus for generating spectral replacement values 620 according to one of the above described embodiments.

The apparatus for decoding spectral audio signal values 610 generates the spectral values of the decoded audio signal as just described, when an error-free audio frame arrives.

In the embodiment of FIG. 6, the spectral values of the synthesis signal may then be stored in a buffer unit of the apparatus 620 for generating spectral replacement values. These spectral values of the decoded audio signal have been decoded based on the received error-free audio frame, and thus relate to the previously received error-free audio frame.

When a current frame is missing or erroneous, the apparatus 620 for generating spectral replacement values is informed that spectral replacement values are needed. The concealment frame generator of the apparatus 620 for generating spectral replacement values then generates spectral replacement values according to one of the above-described embodiments.

For example, the spectral values from the last good frame are slightly modified by the concealment frame generator by randomly flipping their sign. Then, a fade out is applied on these spectral values. The fade out may depend on the stability of the previous prediction filter and on the number of consecutive lost frames. The generated spectral replacement values are then used as spectral replacement values for the audio signal, and then a frequency to time transformation is conducted to obtain a time-domain audio signal.

In LD-USAC, as well as in USAC and MPEG-4 (MPEG=Moving Picture Experts Group), temporal noise shaping (TNS) may be employed. By temporal noise shaping, the fine time structure of noise is controlled. On a decoder side, a filter operation is applied on the spectral data based on noise shaping information. More information on temporal noise shaping can, for example, be found in:

[4]: ISO/IEC 14496-3:2005: Information technology—Coding of audio-visual objects—Part 3: Audio, 2005

Embodiments are based on the finding that in case of an onset/a transient, TNS is highly active. Thus, by determining whether the TNS is highly active or not, it can be estimated, whether an onset/a transient is present.

According to an embodiment, a prediction gain that TNS has, is calculated on receiver side. On receiver side, at first, the received spectral values of a received error-free audio frame are processed to obtain first intermediate spectral values $a_i$. Then, TNS is conducted and by this, second intermediate spectral values b, are obtained. A first energy value $E_1$ is calculated for the first intermediate spectral values and a second energy value $E_2$ is calculated for the second intermediate spectral values. To obtain the prediction gain $g_{TNS}$ of the TNS, the second energy value may be divided by the first energy value.

For example, $g_{TNS}$ may be defined as:

$$g_{TNS} = E_2 / E_1$$

$$E_2 = \sum_{i=0}^{n} b_i^2 = b_1^2 + b_2^2 + \ldots + b_n^2$$

-continued $$E_1 = \sum_{i=1}^{n} a_i^2 = a_1^2 + a_2^2 + \ldots + a_n^2$$

($n$ = number of considered spectral values)

According to an embodiment, the concealment frame generator is adapted to generate the spectral replacement values based on the previous spectral values, based on the filter stability value and also based on a prediction gain of a temporal noise shaping, when temporal noise shaping is conducted on a previously received error-free frame. According to another embodiment, the concealment frame generator is adapted to generate the spectral replacement values furthermore based on the number of consecutive missing or erroneous frames.

The higher the prediction gain is, the faster should the fade out be. For example, consider a filter stability value of 0.5 and assume that the prediction gain is high, e.g. $g_{TNS}$=6; then a fade out factor, may, for example be 0.65 (=fast fade out). In contrast, again, consider a filter stability value of 0.5, but assume that the prediction gain is low, e.g. 1.5; then a fade out factor may, for example be 0.95 (=slow fade out).

The prediction gain of the TNS may also influence, which values should be stored in the buffer unit of an apparatus for generating spectral replacement values.

If the prediction gain $g_{TNS}$ is lower than a certain threshold (e.g. threshold=5.0), then the spectral values after the TNS has been applied are stored in the buffer unit as previous spectral values. In case of a missing or erroneous frame, the spectral replacement values are generated based on these previous spectral values.

Otherwise, if the prediction gain $g_{TNS}$ is greater than or equal to the threshold value, the spectral values before the TNS has been applied are stored in the buffer unit as previous spectral values. In case of a missing or erroneous frame, the spectral replacement values are generated based on these previous spectral values.

TNS is not applied in any case on these previous spectral values.

Figure 7:
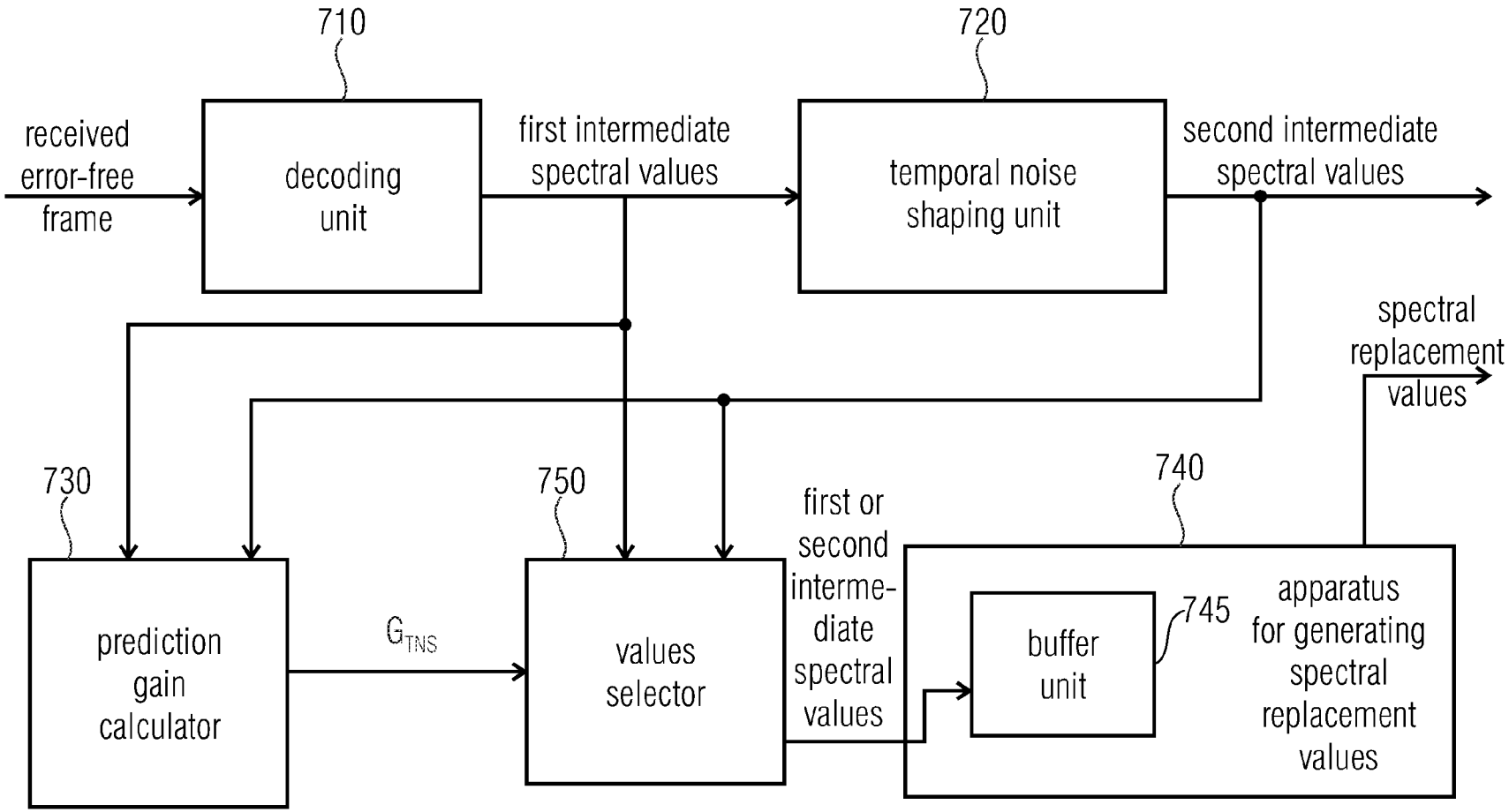
FIG. 7 illustrates an audio signal decoder according to another embodiment.

Accordingly, FIG. 7 illustrates an audio signal decoder according to a corresponding embodiment. The audio signal decoder comprises a decoding unit 710 for generating first intermediate spectral values based on a received error-free frame. Moreover, the audio signal decoder comprises a temporal noise shaping unit 720 for conducting temporal noise shaping on the first intermediate spectral values to obtain second intermediate spectral values. Furthermore, the audio signal decoder comprises a prediction gain calculator 730 for calculating a prediction gain of the temporal noise shaping depending on the first intermediate spectral values and the second intermediate spectral values. Moreover, the audio signal decoder comprises an apparatus 740 according to one of the above-described embodiments for generating spectral replacement values when a current audio frame has not been received or is erroneous. Furthermore, the audio signal decoder comprises a values selector 750 for storing the first intermediate spectral values in the buffer unit 745 of the apparatus 740 for generating spectral replacement values, if the prediction gain is greater than or equal to a threshold value, or for storing the second intermediate spectral values in the buffer unit 745 of the apparatus 740 for generating spectral replacement values, if the prediction gain is smaller than the threshold value.

The threshold value may, for example, be a predefined value. E.g. the threshold value may be predefined in the audio signal decoder.

According to another embodiment, concealment is conducted on the spectral data just after the first decoding step and before any noise-filling, global gain and/or TNS is conducted.

Figure 8:
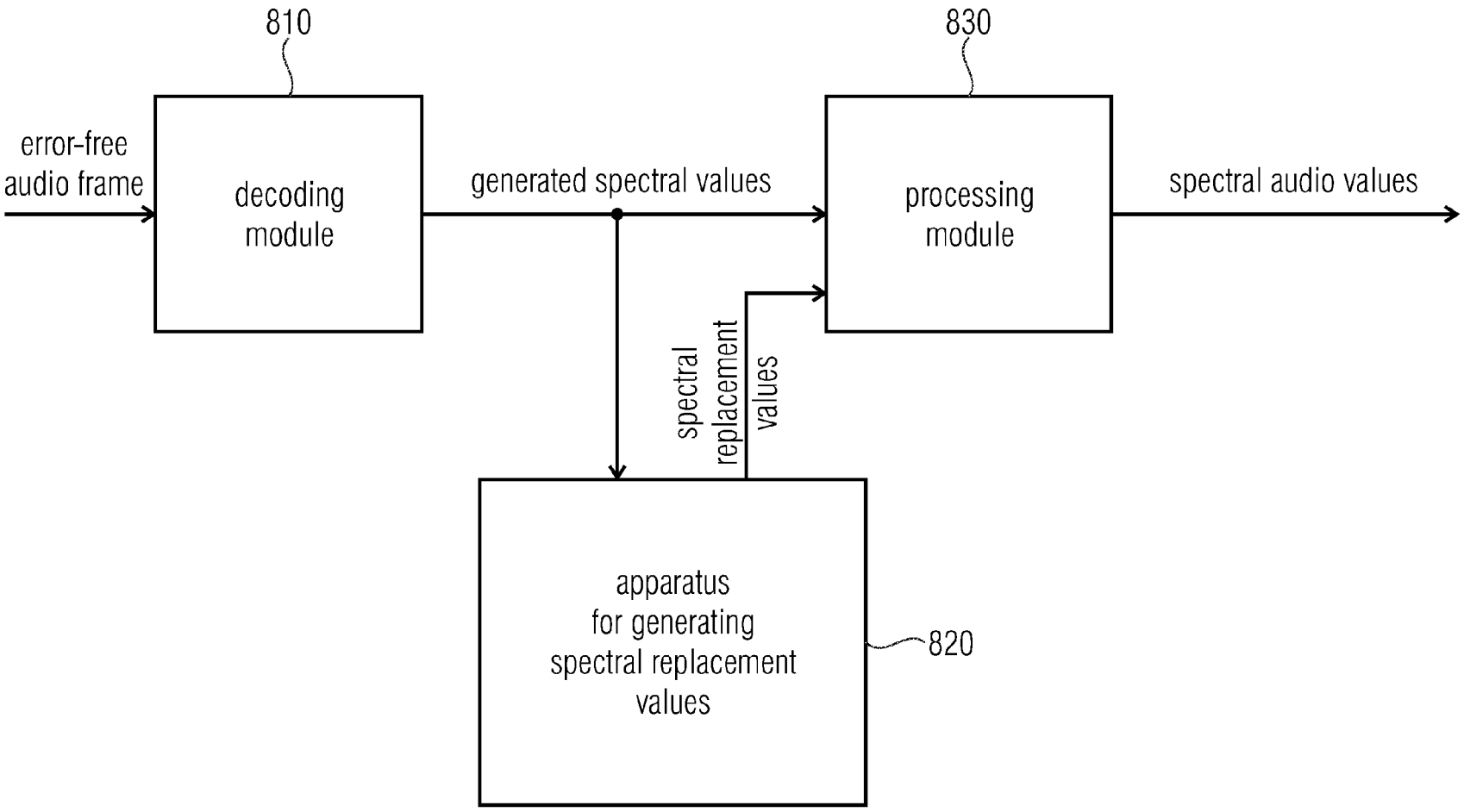
FIG. 8 illustrates an audio signal decoder according to a further embodiment.

Such an embodiment is depicted in FIG. 8. FIG. 8 illustrates a decoder according to a further embodiment. The decoder comprises a first decoding module 810. The first decoding module 810 is adapted to generate generated spectral values based on a received error-free audio frame. The generated spectral values are then stored in the buffer unit of an apparatus 820 for generating spectral replacement values. Moreover, the generated spectral values are input into a processing module 830, which processes the generated spectral values by conducting TNS, applying noise-filling and/or by applying a global gain to obtain spectral audio values of the decoded audio signal. If a current frame is missing or erroneous, the apparatus 820 for generating spectral replacement values generates the spectral replacement values and feeds them into the processing module 830.

According to the embodiment illustrated in FIG. 8, the decoding module or the processing module conduct some or all of the following steps in case of concealment:

The spectral values, e.g. from the last good frame, are slightly modified by randomly flipping their sign. In a further step, noise-filling is conducted based on random noise on the spectral bins quantized to zero. In another step, the factor of noise is slightly adapted compared to the previously received error-free frame.

In a further step, spectral noise-shaping is achieved by applying the LPC-coded (LPC=Linear Predictive Coding) weighted spectral envelope in the frequency-domain. For example, the LPC coefficients of the last received error-free frame may be used. In another embodiment, averaged LPC-coefficients may be used. For example, an average of the last three values of a considered LPC coefficient of the last three received error-free frames may be generated for each LPC coefficient of a filter, and the averaged LPC coefficients may be applied.

In a subsequent step, a fade out may be applied on these spectral values. The fade out may depend on the number of consecutive missing or erroneous frames and on the stability of the previous LP filter. Moreover, prediction gain information may be used to influence the fade out. The higher the prediction gain is, the faster the fade out may be. The embodiment of FIG. 8 is slightly more complex than the embodiment of FIG. 6, but provides better audio quality.

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus.

Depending on certain implementation requirements, embodiments of the invention can be implemented in hardware or in software. The implementation can be performed using a digital storage medium, for example a floppy disk, a DVD, a CD, a ROM, a PROM, an EPROM, an EEPROM or a FLASH memory, having electronically readable control signals stored thereon, which cooperate (or are capable of cooperating) with a programmable computer system such that the respective method is performed.

Some embodiments according to the invention comprise a data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may for example be stored on a machine readable carrier.

Other embodiments comprise the computer program for performing one of the methods described herein, stored on a machine readable carrier or a non-transitory storage medium.

In other words, an embodiment of the inventive method is, therefore, a computer program having a program code for performing one of the methods described herein, when the computer program runs on a computer.

A further embodiment of the inventive methods is, therefore, a data carrier (or a digital storage medium, or a computer-readable medium) comprising, recorded thereon, the computer program for performing one of the methods described herein.

A further embodiment of the inventive method is, therefore, a data stream or a sequence of signals representing the computer program for performing one of the methods described herein. The data stream or the sequence of signals may for example be configured to be transferred via a data communication connection, for example via the Internet or over a radio channel.

A further embodiment comprises a processing means, for example a computer, or a programmable logic device, configured to or adapted to perform one of the methods described herein.

A further embodiment comprises a computer having installed thereon the computer program for performing one of the methods described herein.

In some embodiments, a programmable logic device (for example a field programmable gate array) may be used to perform some or all of the functionalities of the methods described herein. In some embodiments, a field programmable gate array may cooperate with a microprocessor in order to perform one of the methods described herein. Generally, the methods are advantageously performed by any hardware apparatus.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations and equivalents as fall within the true spirit and scope of the present invention.

LITERATURE

[1]: 3GPP, "Audio codec processing functions; Extended Adaptive Multi-Rate—Wideband (AMR-WB+) codec; Transcoding functions", 2009, 3GPP TS 26.290.

[2]: USAC codec (Unified Speech and Audio Codec), ISO/IEC CD 23003-3 dated Sep. 24, 2010

[3]: 3GPP, "Speech codec speech processing functions; Adaptive Multi-Rate—Wideband (AMR-WB) speech codec; Transcoding functions", 2009, V9.0.0, 3GPP TS 26.190.

[4]: ISO/IEC 14496-3:2005: Information technology—Coding of audio-visual objects—Part 3: Audio, 2005

[5]: ITU-T G.718 (06-2008) specification

The invention claimed is:

1. An apparatus for generating spectral replacement values for an audio signal comprising:

a buffer unit for storing previous spectral values relating to a previously received error-free audio signal frame, and a concealment frame generator for generating the spectral replacement values when a current audio signal frame has not been received or is erroneous, wherein the previously received error-free audio signal frame comprises filter information, the filter information comprising an associated filter stability value indicating a stability of a prediction filter, and wherein the concealment frame generator is adapted to generate the spectral replacement values based on the previous spectral values and based on the filter stability value, wherein during a playback of the audio signal, at a receiver, the current audio signal frame that has not been received in time or is erroneous is replaced with a synthesized representation of the generated spectral replacement values, wherein the apparatus is implemented using a hardware apparatus or a computer or a combination of a hardware apparatus and a computer.

2. The apparatus according to claim 1, wherein the concealment frame generator is adapted to generate the spectral replacement values by randomly flipping the sign of the previous spectral values.

3. The apparatus according to claim 1, wherein the concealment frame generator is configured to generate the spectral replacement values by multiplying each of the previous spectral values by a first gain factor when the filter stability value comprises a first value, and by multiplying each of the previous spectral values by a second gain factor, being smaller than the first gain factor, when the filter stability value comprises a second value being smaller than the first value.

4. The apparatus according to claim 1, wherein the concealment frame generator is adapted to generate the spectral replacement values based on the filter stability value, wherein the previously received error-free audio signal frame comprises first predictive filter coefficients of the prediction filter, wherein a predecessor frame of the previously received error-free audio signal frame comprises second predictive filter coefficients, and wherein the filter stability value depends on the first predictive filter coefficients and on the second predictive filter coefficients.

5. The apparatus according to claim 4, wherein the concealment frame generator is adapted to determine the filter stability value based on the first predictive filter coefficients of the previously received error-free audio signal frame and based on the second predictive filter coefficients of the predecessor frame of the previously received error-free audio signal frame.

6. The apparatus according to claim 4, wherein the concealment frame generator is adapted to generate the spectral replacement values based on the filter stability value, wherein the filter stability value depends on a distance measure $LSF_{dist}$, and wherein the distance measure $LSF_{dist}$ is defined by the formula:

$$LSF_{dist} = \sum_{i=0}^{u} \left(f_i - f_i^{(p)}\right)^2$$

wherein u+1 specifies a total number of the first predictive filter coefficients of the previously received error-free audio signal frame, and wherein u+1 also specifies a total number of the second predictive filter coefficients of the predecessor frame of the previously received error-free audio signal frame, wherein $f_i$ specifies the i-th filter coefficient of the first predictive filter coefficients and wherein $f_i^{(p)}$ specifies the i-th filter coefficient of the second predictive filter coefficients.

7. The apparatus according to claim 1, wherein the concealment frame generator is adapted to generate the spectral replacement values furthermore based on frame class information relating to the previously received error-free audio signal frame.

8. The apparatus according to claim 7, wherein the concealment frame generator is adapted to generate the spectral replacement values based on the frame class information, wherein the frame class information indicates that the previously received error-free audio signal frame is classified as "artificial onset", "onset", "voiced transition", "unvoiced transition", "unvoiced" or "voiced".

9. The apparatus according to claim 1, wherein the concealment frame generator is adapted to generate the spectral replacement values furthermore based on a number of consecutive frames that did not arrive at a receiver or that were erroneous, since a last error-free audio signal frame had arrived at the receiver, wherein no other error-free audio signal frames arrived at the receiver since the last error-free audio signal frame had arrived at the receiver.

10. The apparatus according to claim 9, wherein the concealment frame generator is adapted to calculate a fade out factor, based on the filter stability value and based on the number of consecutive frames that did not arrive at the receiver or that were erroneous, and wherein the concealment frame generator is adapted to generate the spectral replacement values by multiplying the fade out factor by at least some of the previous spectral values, or by at least some values of a group of intermediate values, wherein each one of the intermediate values depends on at least one of the previous spectral values.

11. The apparatus according to claim 1, wherein the concealment frame generator is adapted to generate the spectral replacement values based on the previous spectral values, based on the filter stability value and also based on a prediction gain of a temporal noise shaping.

12. An audio signal decoder comprising:

an apparatus for decoding spectral audio signal values, and an apparatus for generating spectral replacement values according to claim 1, wherein the apparatus for decoding spectral audio signal values is adapted to decode spectral values of an audio signal based on a previously received error-free audio signal frame, wherein the apparatus for decoding spectral audio signal values is furthermore adapted to store the spectral values of the audio signal in the buffer unit of the apparatus for generating spectral replacement values, and wherein the apparatus for generating spectral replacement values is adapted to generate the spectral replacement values based on the spectral values stored in the buffer unit, when a current audio signal frame has not been received or is erroneous, wherein the apparatus for decoding spectral audio signal values is implemented using a hardware apparatus or a computer or a combination of a hardware apparatus and a computer.

13. An audio signal decoder, comprising:

a decoding unit for generating first intermediate spectral values based on a received error-free audio signal frame, a temporal noise shaping unit for conducting temporal noise shaping on the first intermediate spectral values to acquire second intermediate spectral values, a prediction gain calculator for calculating a prediction gain of the temporal noise shaping depending on the first intermediate spectral values and depending on the second intermediate spectral values, an apparatus according to claim 1, for generating spectral replacement values when a current audio signal frame has not been received or is erroneous, and a values selector for storing the first intermediate spectral values in the buffer unit of the apparatus for generating spectral replacement values, if the prediction gain is greater than or equal to a threshold value, or for storing the second intermediate spectral values in the buffer unit of the apparatus for generating spectral replacement values, if the prediction gain is smaller than the threshold value;

wherein the decoding unit, the temporal noise shaping unit, the prediction gain calculator, and the values selector are implemented using a hardware apparatus or a computer or a combination of a hardware apparatus and a computer.

14. An audio signal decoder, comprising:

a first decoding module for generating generated spectral values based on a received error-free audio signal frame, an apparatus for generating spectral replacement values according to claim 1, and a processing module for processing the generated spectral values by conducting temporal noise shaping, applying noise-filling or applying a global gain, to acquire spectral audio values of the decoded audio signal, wherein the apparatus for generating spectral replacement values is adapted to generate spectral replacement values and to feed them into the processing module, when a current frame has not been received or is erroneous; and wherein the first decoding module and the processing module are implemented using a hardware apparatus or a computer or a combination of a hardware apparatus and a computer.

15. A method for generating spectral replacement values for an audio signal comprising:

storing previous spectral values relating to a previously received error-free audio signal frame, and generating the spectral replacement values when a current audio signal frame has not been received or is erroneous, wherein the previously received error-free audio signal frame comprises filter information, the filter information comprising an associated filter stability value indicating a stability of a prediction filter defined by the filter information, wherein the spectral replacement values are generated based on the previous spectral values and based on the filter stability value, wherein during a playback of the audio signal, at a receiver, the current audio signal frame that has not been received in time or is erroneous is replaced with a synthesized representation of the generated spectral replacement values, wherein the method is performed using a hardware apparatus or a computer or a combination of a hardware apparatus and a computer.

16. A non-transitory computer-readable medium comprising a computer program for implementing the method of claim 15, when the computer program is executed by a computer or signal processor.

* * * * *